US011213931B2

(12) United States Patent
Li

(10) Patent No.: US 11,213,931 B2
(45) Date of Patent: Jan. 4, 2022

(54) RATCHET SEAT, A RATCHET TOOL HEAD, AND A BIDIRECTIONAL RATCHET HAND TOOL

(71) Applicants: HUA WEI TOOLS CO., LTD., Yunlin County (TW); JOONG JYA ENTERPRISE CO., LTD., Taichung (TW)

(72) Inventor: Zhong-Song Li, Yunlin County (TW)

(73) Assignee: HUA WEI TOOLS CO., LTD., Yunlin County (TW)

( * ) Notice: Subject to any disclaimer, the term of this patent is extended or adjusted under 35 U.S.C. 154(b) by 0 days.

(21) Appl. No.: 17/023,881

(22) Filed: Sep. 17, 2020

(65) Prior Publication Data

US 2021/0339360 A1 Nov. 4, 2021

(30) Foreign Application Priority Data

Apr. 29, 2020 (TW) ..... 109114334

(51) Int. Cl.
*B25B 13/46* (2006.01)
*B25B 23/00* (2006.01)

(52) U.S. Cl.
CPC ..... *B25B 13/463* (2013.01); *B25B 23/0007* (2013.01)

(58) Field of Classification Search
CPC ..... B25B 13/463; B25B 23/0007
USPC ..... 81/60–63.1, 177.8, 177.9
See application file for complete search history.

(56) References Cited

U.S. PATENT DOCUMENTS 2,921,773 A * 1/1960 Hoelzer ..... B65G 7/12 254/129
4,270,417 A * 6/1981 Tesoro ..... B25B 13/466 81/58.3
4,479,409 A * 10/1984 Antonius ..... B25B 13/466 81/58.3
5,782,147 A * 7/1998 Chaconas ..... B25B 13/463 192/43.1
5,820,288 A * 10/1998 Cole ..... B25G 3/38 403/97
5,857,390 A * 1/1999 Whiteford ..... B25B 13/06 81/62
6,000,299 A * 12/1999 Cole ..... B25B 13/461 81/177.7

(Continued)

*Primary Examiner* — Joseph J Hail
*Assistant Examiner* — Jonathan R Zaworski
(74) *Attorney, Agent, or Firm* — Sinorica, LLC

(57) ABSTRACT

A ratchet seat, a ratchet tool head, and a bidirectional ratchet hand tool are disclosed. A handle unit includes an annular groove and a cavity. A positioning ring is stretchably disposed in the annular groove. A first actuating unit and a second actuating unit are elastically placed one over another in the cavity. An outer peripheral surface of a ratchet seat forms a ratchet toothed portion and a positioning groove. The ratchet seat is movable between a first position and a second position in an up-down direction. When the first position is assumed, the positioning groove is slidably moved to engage with the positioning ring, and the first actuating unit meshes with the ratchet toothed portion. When the second position is assumed, the positioning groove disengages from the positioning ring, and the second actuating unit meshes with the ratchet toothed portion.

13 Claims, 16 Drawing Sheets

(56) References Cited

U.S. PATENT DOCUMENTS 6,070,499 A * 6/2000 Wisbey ..... B25B 13/467 81/57.29
6,161,982 A * 12/2000 Cole ..... B25B 13/481 403/298
6,186,033 B1 * 2/2001 Faro, Sr. ..... B25B 23/0014 81/177.6
6,216,565 B1 * 4/2001 McCann ..... B25G 1/063 403/97
6,840,141 B2 * 1/2005 Cole ..... B25G 1/063 403/298
7,156,003 B2 * 1/2007 Cole ..... B25G 1/063 403/97
7,216,568 B1 * 5/2007 Hsieh ..... B25B 13/463 81/124.3
7,591,208 B2 * 9/2009 Cole ..... B25G 1/025 403/103
7,628,382 B2 * 12/2009 Cole ..... B25C 11/00 254/131
7,987,749 B2 * 8/2011 Hsieh ..... B25G 1/063 81/177.8
8,424,845 B2 * 4/2013 Cole ..... B25C 11/00 254/26 R
9,649,751 B2 * 5/2017 Huang ..... B25B 13/463
9,757,844 B2 * 9/2017 Chen ..... B25B 13/463
9,815,179 B2 * 11/2017 Anderson ..... B25B 13/463
9,969,064 B2 * 5/2018 Huang ..... B25B 13/463
10,105,828 B2 * 10/2018 Wang ..... B25B 13/463
10,160,104 B2 * 12/2018 Hu ..... B25B 13/465
10,226,861 B2 * 3/2019 Lee ..... B25B 13/461
10,279,458 B2 * 5/2019 Li ..... B25B 13/463
10,286,531 B2 * 5/2019 Hu ..... B25B 13/463
10,464,191 B2 * 11/2019 Anderson ..... B25B 13/463
2004/0089108 A1 * 5/2004 Chang ..... B25B 13/465 81/62
2004/0177725 A1 * 9/2004 Shih-Yueh ..... B25B 23/0035 81/63.1
2013/0228049 A1 * 9/2013 Shen ..... B25B 13/463 81/63.1
2013/0269488 A1 * 10/2013 Huang ..... B25B 13/463 81/60
2018/0297177 A1 * 10/2018 Li ..... B25B 13/463

* cited by examiner

RATCHET SEAT, A RATCHET TOOL HEAD, AND A BIDIRECTIONAL RATCHET HAND TOOL

BACKGROUND OF THE INVENTION

1. Field of the Invention

This invention relates to a hand tool and relates particularly to a ratchet seat, a ratchet tool head, and a bidirectional ratchet hand tool.

2. Description of the Related Art

Referring to FIG. 1 and FIG. 2, a conventional bidirectional ratchet wrench 1 includes a main body 11, a ratchet wheel 12, two ratchet toothed members 13, two compression springs 14, a changeover unit 15, and a bottom plate (not shown). The main body 11 has an accommodation room 110 formed at a front end. The ratchet wheel 12 is rotatably installed in the accommodation room 110 and configured to be sleevedly disposed around a tool head 16. The ratchet toothed members 13 are symmetric and are disposed in the accommodation room 110. Each ratchet toothed member 13 is pivotally disposed on the main body 11 and configured to mesh with the ratchet wheel 12. The compression springs 14 each are elastically disposed between the ratchet toothed members 13 and the main body 11. The compression springs 14 supply potential energy whereby the ratchet toothed members 13 are moved toward the ratchet wheel 12 constantly. The changeover unit 15 is rotatably installed on the main body 11 and adapted to push one of the ratchet toothed members 13 selectively so that the selected ratchet toothed member 13 leaves the ratchet wheel 12. The changeover unit 15 has a curved surface 151 and two propping surfaces 152 inclined to each other. The curved surface 151 is configured to push the ratchet toothed members 13. The propping surfaces 152 are configured to rest against the ratchet toothed members 13. The bottom plate is detachably installed on the main body 11 and adapted to close the accommodation room 110. The tool head 16 penetrates through the bottom plate.

FIG. 1 shows that when the changeover unit 15 is actuated to let the curved surface 151 push the right-hand ratchet toothed member 13, the right-hand ratchet toothed member 13 leaves the ratchet wheel 12, and the left-hand ratchet toothed member 13 meshes with the ratchet wheel 12. This action allows the ratchet wheel 12 to be turned in a clockwise direction. On the contrary, FIG. 2 shows that when the changeover unit 15 is actuated to let the curved surface 151 push the left-hand ratchet toothed member 13, the left-hand ratchet toothed member 13 leaves the ratchet wheel 12, and the right-hand ratchet toothed member 13 meshes with the ratchet wheel 12. This action allows the ratchet wheel 12 to be turned in a counterclockwise direction.

Although the bidirectional ratchet wrench 1 has the features as aforementioned, the wrench still needs not only the essential parts which help the unidirectional turning operation of the ratchet wheel 12 but also auxiliary parts such as the bottom plate configured to close the accommodation room 110 and screws (not shown) configured to fasten the bottom plate and the changeover unit 15. Therefore, the conventional design is assembled by using lots of parts, and the assembly requires a complex procedure and takes more time.

SUMMARY OF THE INVENTION

A first object of this invention is to provide a bidirectional ratchet hand tool with a simple structure capable of being assembled by a simplified procedure.

Accordingly, a bidirectional ratchet hand tool of this invention includes a handle unit, a positioning ring, a first actuating unit, a second actuating unit, and a ratchet tool head.

The handle unit includes a ratchet socket enclosed by an inner wall surface. The inner wall surface includes an annular groove annularly formed and radially extending outwards from the ratchet socket and a cavity communicating with the ratchet socket. The annular groove and the cavity are spaced from each other in an up-down direction. The positioning ring fits a shape of the annular groove and is stretchably disposed in the annular groove. The first actuating unit is elastically disposed in the cavity. The second actuating unit is elastically disposed in the cavity and is placed on the first actuating unit in the up-down direction.

The ratchet tool head is movably disposed in the ratchet socket in the up-down direction and includes a ratchet seat. The ratchet seat meshes with the first actuating unit or the second actuating unit. An outer peripheral surface of the ratchet seat forms a ratchet toothed portion received in the ratchet socket and a positioning groove spaced from the ratchet toothed portion in the up-down direction. The ratchet seat is moved relative to the handle unit by pressing and is movable between a first position and a second position. When the first position is assumed, the positioning groove engages with the positioning ring by sliding, and the first actuating unit meshes with the ratchet toothed portion to allow the ratchet tool head to be turned in one direction. When the second position is assumed, the positioning groove keeps a distance from the positioning ring, and the second actuating unit meshes with the ratchet toothed portion to allow the ratchet tool head to be turned unidirectionally in another direction.

A second object of this invention is to provide a ratchet seat.

Accordingly, a ratchet seat of this invention is adapted to be installed onto a handle unit. The ratchet seat includes an outer peripheral surface. The outer peripheral surface includes a ratchet toothed portion which is formed circumferentially, a positioning groove spaced from the ratchet toothed portion in an up-down direction and formed circumferentially, and a first support portion and a second support portion which are respectively disposed on opposite sides of the ratchet toothed portion. The second support portion is situated between the positioning groove and the ratchet toothed portion. An outer diameter of the positioning groove and an outer diameter of the first support portion are smaller than an outer diameter of the ratchet toothed portion. The ratchet seat is movable relative to the handle unit in the up-down direction, thereby changing a turning direction of the ratchet seat.

A third object of this invention is to provide a ratchet tool head.

Accordingly, a ratchet tool head of this invention is adapted to be installed onto a handle unit. The ratchet tool head includes a ratchet seat and a driving head.

The ratchet seat includes an outer peripheral surface. The outer peripheral surface includes a ratchet toothed portion which is formed circumferentially, a positioning groove spaced from the ratchet toothed portion in an up-down direction and formed circumferentially, and a first support portion and a second support portion which are respectively disposed on opposite sides of the ratchet toothed portion. The second support portion is situated between the positioning groove and the ratchet toothed portion. An outer diameter of the positioning groove and an outer diameter of the first support portion are smaller than an outer diameter of the ratchet toothed portion. The ratchet seat is movable relative to the handle unit in the up-down direction, thereby changing a turning direction of the ratchet seat.

The driving head extends outwards from the ratchet seat in the up-down direction, and the driving head turns when the ratchet seat is turned.

The effects of this invention are described as follows. In assembly terms, the user only needs to install the positioning ring, the first actuating unit, the second actuating unit, and the ratchet tool head onto the handle unit sequentially, and then the assembly is done without screwing. Therefore, this invention is assembled with a simplified procedure and is quickly assembled. A simple structure is also attained. Concurrently, because the first actuating unit and the second actuating unit are placed one over another in the up-down direction, the turning direction of the ratchet seat can be changed by pressing the ratchet seat. This intuitive pressing operation disclosed in this invention is very convenient.

BRIEF DESCRIPTION OF THE DRAWINGS

Other features and effects of this invention will be clearly shown by reference to the preferred embodiments when considered in connection with the accompanying drawings and wherein.

DETAILED DESCRIPTION OF THE PREFERRED EMBODIMENTS

Figure 1:
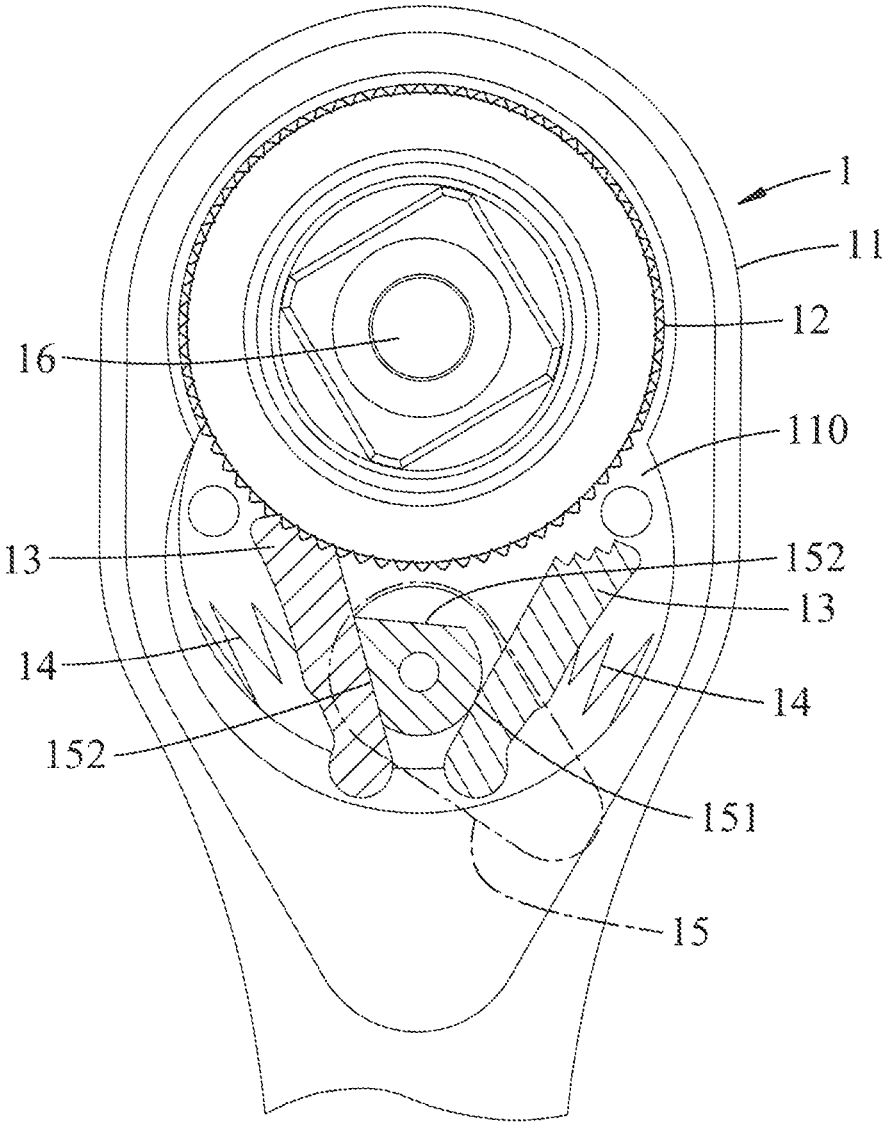
FIG. 1 is a schematic view of a conventional bidirectional ratchet wrench showing that a changeover unit is rotated to make a right-hand ratchet toothed member leave a ratchet wheel and make a left-hand ratchet toothed member mesh with the ratchet wheel.
Figure 2:
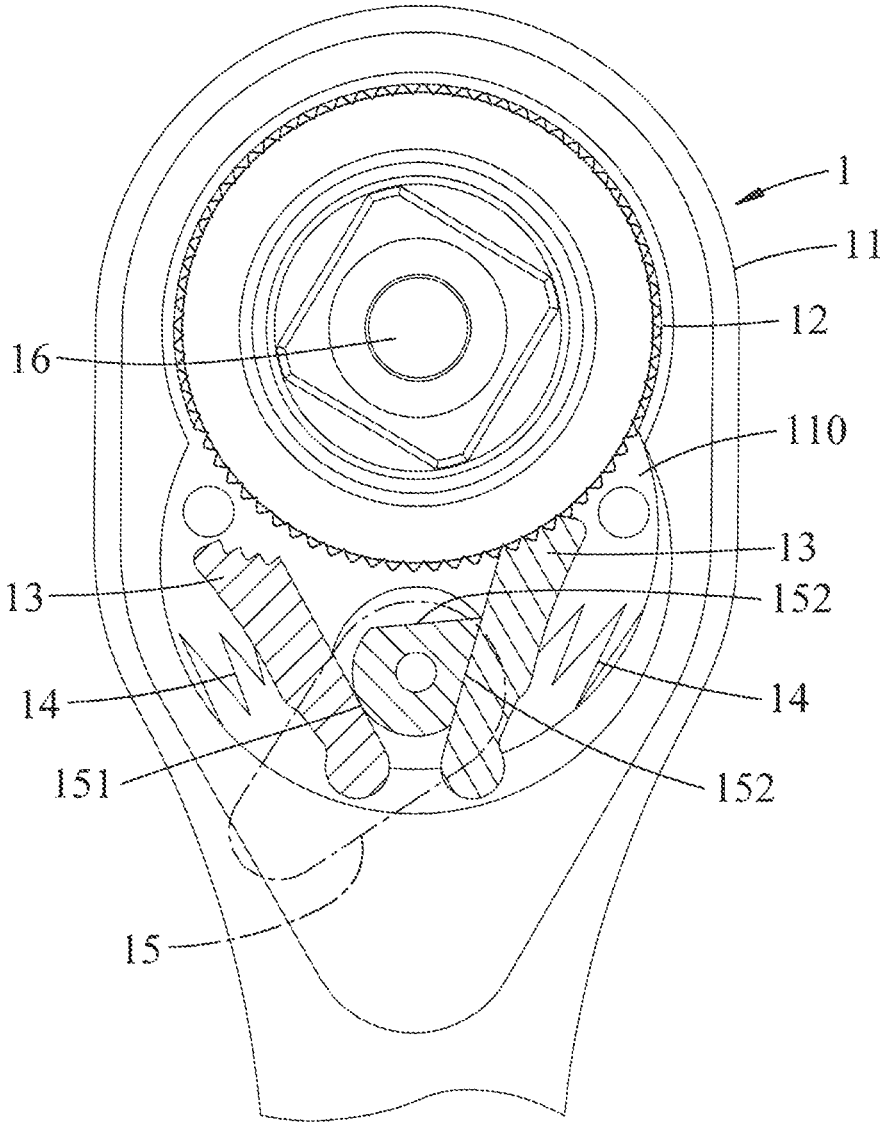
FIG. 2 is a schematic view of the conventional bidirectional ratchet wrench showing that the changeover unit is rotated counterclockwise to make the left-hand ratchet toothed member leave the ratchet wheel and make the right-hand ratchet toothed member mesh with the ratchet wheel.

Before describing in greater detail, it should note that similar elements are denoted by same reference numerals throughout the disclosure. It is noted that the positions or directions described in the disclosure are connected with the accompanying drawings shown for reference. For example, the described term "right-hand" means the right side of something shown in corresponding drawings.

Figure 3:
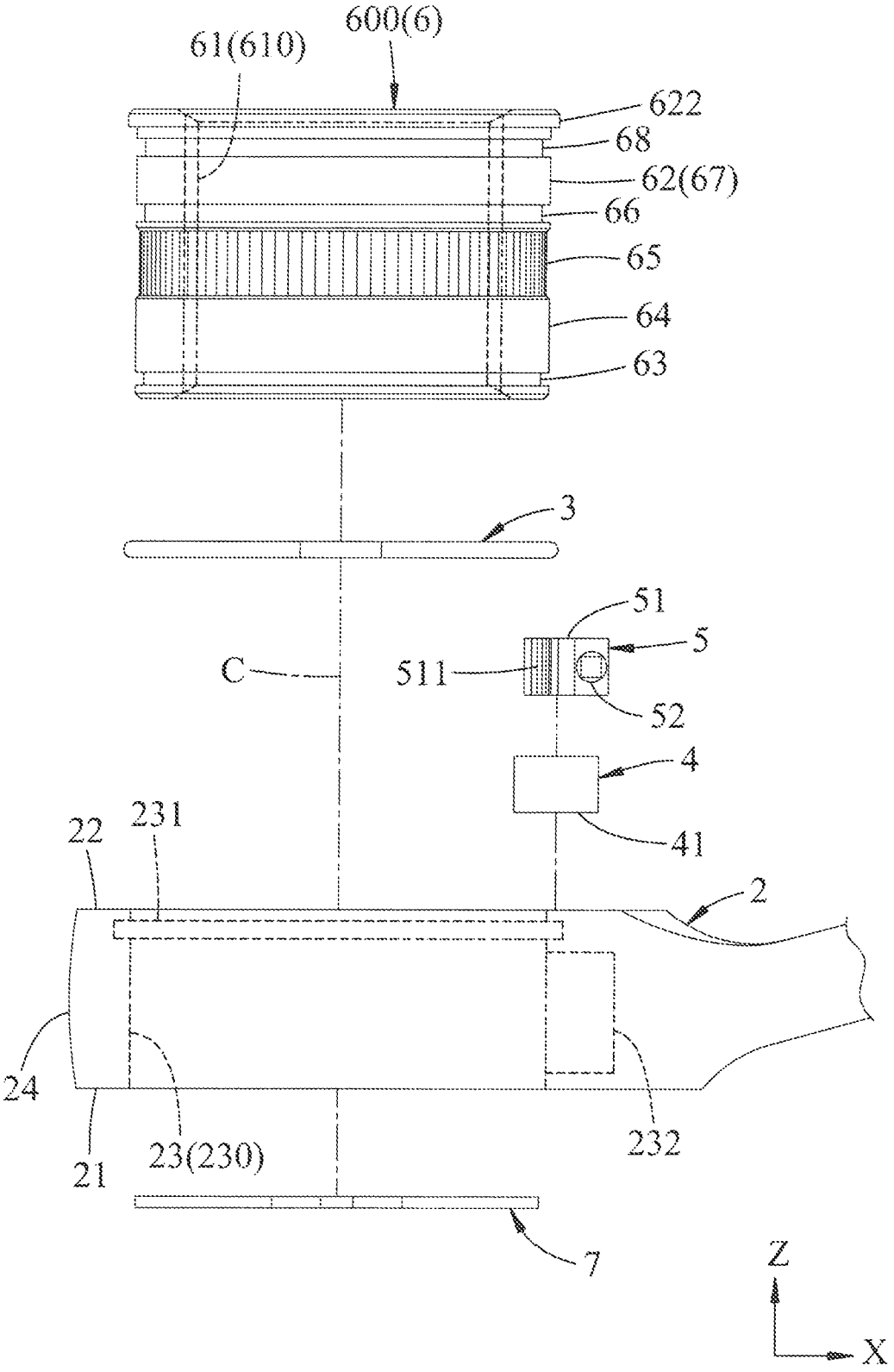
FIG. 3 is a partial exploded view of a first preferred embodiment of this invention showing that a ratchet tool head of the first preferred embodiment is installed onto a handle unit.
Figure 4:
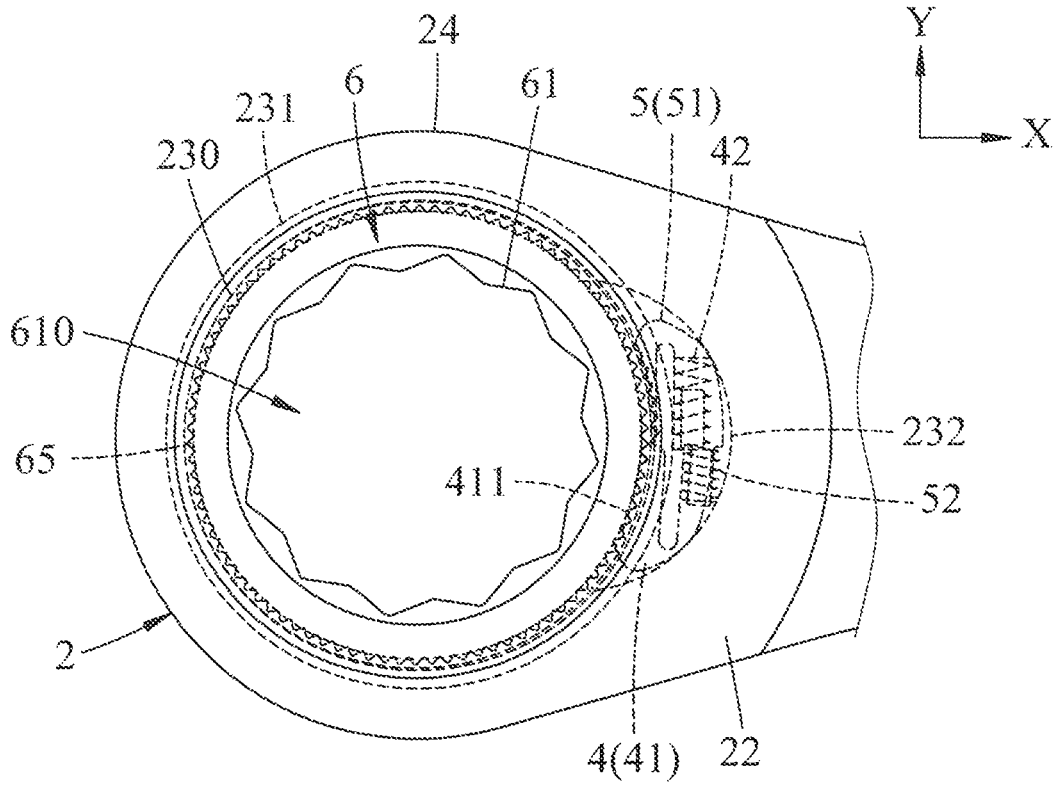
FIG. 4 is a partial top plan view showing that a first actuating unit and a second actuating unit of the first preferred embodiment are disposed in the handle unit.
Figure 5:
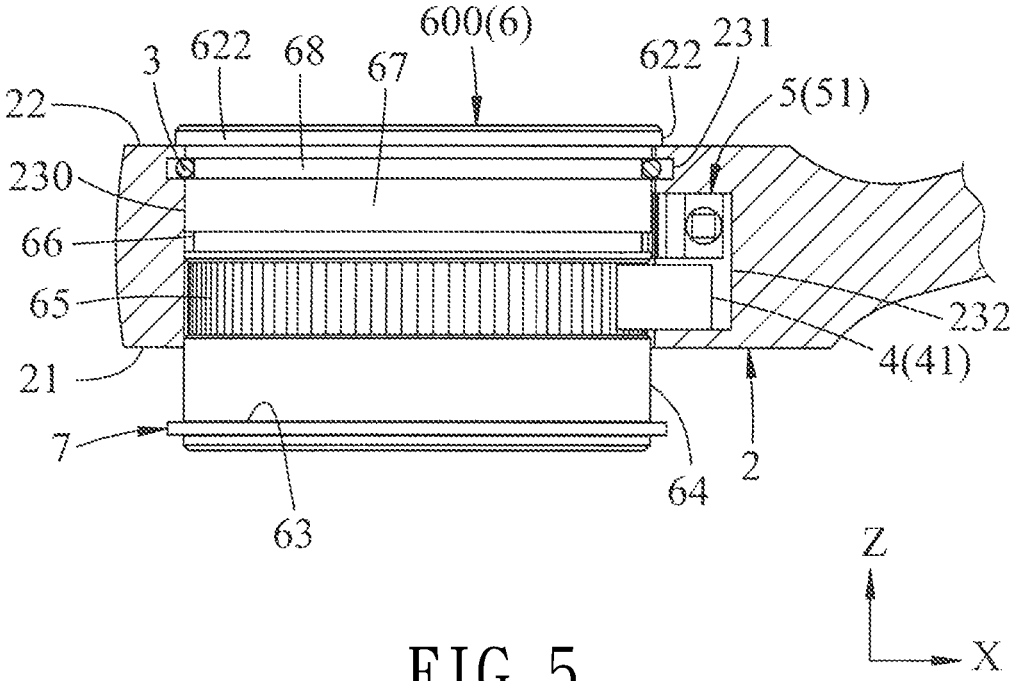
FIG. 5 is a partial cross-sectional view showing that when a ratchet seat of the ratchet tool head is moved relative to the handle unit and moved to a first position, the first actuating unit meshes with the ratchet seat, and a positioning groove of the ratchet seat engages with a positioning ring by sliding.

Referring to FIGS. 3 to 5, a first preferred embodiment of a bidirectional ratchet hand tool of this invention includes a handle unit 2, a positioning ring 3, a first actuating unit 4, a second actuating unit 5, a ratchet tool head 600, and a limiting ring 7. The first preferred embodiment is a bidirectional ratchet socket wrench capable of being positioned on two sides.

The handle unit 2 has a bottom surface 21 and a top surface 22 which are defined at opposite ends in an up-down direction Z and has an inner wall surface 23 and an outer wall surface 24 which are connected to the bottom surface 21 and the top surface 22 and are defined on opposite sides. A ratchet socket 230 is enclosed by the inner wall surface 23. The ratchet socket 230 extends in the up-down direction Z and penetrates through the bottom surface 21 and the top surface 22. The inner wall surface 23 includes an annular groove 231 which is circumferentially formed and a cavity 232. The annular groove 231 is adjacent to the top surface 22 and is formed by extending radially and outwards from the ratchet socket 230. The cavity 232 is adjacent to the bottom surface 21 and spaced from the annular groove 231 in the up-down direction Z. The cavity 232 extends backwards from the ratchet socket 230 in a front-back direction X. The cavity 232 is substantially formed in a shape of a circular arc and is in communication with the ratchet socket 230. In the first preferred embodiment, the cavity 232 is formed below the annular groove 231. However, in other variations, the height positions of the cavity 232 and the annular groove 231 can be interchangeable, and the cavity 232 can be defined on a front side of the handle unit 2. Therefore, the positions of the cavity 232 and the annular groove 231 should not be limited, and the variations can still be included in the scope of this invention.

Figure 6:
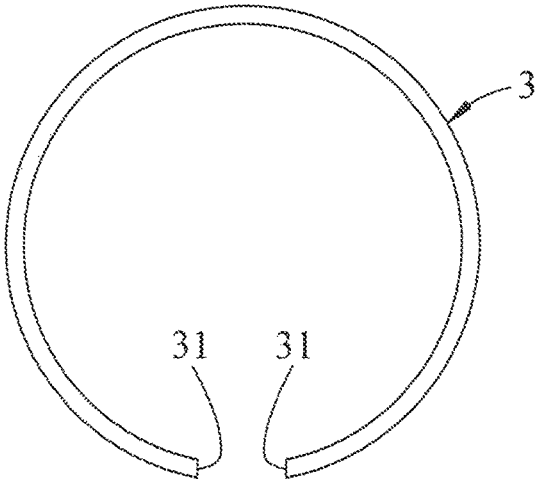
FIG. 6 is a top plan view of the positioning ring.

As shown in FIG. 3, FIG. 5, and FIG. 6, the positioning ring 3 is designed to fit a shape of the annular groove 231 and is installed in the annular groove 231 in a stretchable manner. Preferably, the positioning ring 3 is a circular C-shaped ring with two opposite circular cut surfaces 31 spaced from each other. The circular cut surfaces 31 are forced to be away from each other by adding force to the positioning ring 3. The circular cut surfaces 31 spring back when the force is released so that they are close to each other. Therefore, the positioning ring 3 is springy and capable of being stretched. However, in other variations, the positioning ring 3 can be a flat C-shaped ring, the cross section of which is not limited in this invention.

Figure 7:
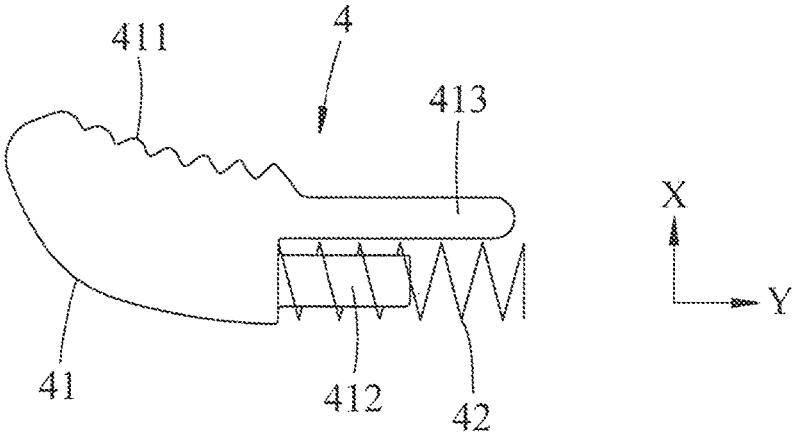
FIG. 7 is a top plan view showing that the first actuating unit includes a first actuating part and a first elastic member.

Referring to FIG. 3, FIG. 4, and FIG. 7, the first actuating unit 4 is disposed in the cavity 232 in a springing or elastic manner. The first actuating unit 4 includes a first actuating part 41 movable relative to the cavity 232 and a first elastic member 42 configured to push the first actuating part 41 by elasticity. The first actuating part 41 includes an engagement toothed portion 411. The first elastic member 42 is a compression spring spirally extending in a left-right direction Y.

Referring to FIG. 3, FIG. 4, and FIG. 5, the second actuating unit 5 is disposed in the cavity 232 in a springing or elastic manner and is placed on a top side of the first actuating unit 4 in the up-down direction Z. The second actuating unit 5 includes a second actuating part 51 movable relative to the cavity 232 and a second elastic member 52 configured to push the second actuating part 51 by elasticity. The second actuating part 51 includes an engagement toothed portion 511. The second elastic member 52 is a compression spring spirally extending in the left-right direction Y. The first actuating part 41 and the second actuating part 51 have the same structure and shape, so only the first actuating part 41 is described in detail in the following paragraphs.

FIG. 7 shows that the first actuating part 41 further includes a shaft portion 412 extending from the engagement toothed portion 411 in the left-right direction Y and an extension portion 413 extending outwards from the engagement toothed portion 411 in a direction corresponding to the extension direction of the shaft portion 412.

Referring to FIG. 3, FIG. 4, and FIG. 7, the first elastic member 42 is sleevedly disposed around the shaft portion 412 of the first actuating part 41 to brace elastically between the engagement toothed portion 411 and the handle unit 2, and the extension portion 413 has a limiting effect on the first elastic member 42 to prevent the displacement and deformation of the first elastic member 42 during its springing action. The second elastic member 52 braces elastically between the engagement toothed portion 511 and the handle unit 2. Accordingly, the first elastic member 42 and the second elastic member 52 each supply potential energy whereby the first actuating part 41 and the second actuating part 51 each are pushed constantly.

Referring to FIG. 3 and FIG. 5, the ratchet tool head 600 is installed onto the handle unit 2 along an axis C and is movable relative to the handle unit 2 in the up-down direction Z. The axis C is substantially parallel to the up-down direction Z. The ratchet tool head 600 includes a ratchet seat 6 rotatably disposed in the ratchet socket 230. The ratchet tool head 600 is operationally moved relative to the handle unit 2 in the up-down direction Z and is capable of meshing with the first actuating unit 4 or the second actuating unit 5. Thus, a turning direction of the ratchet tool head 600 can be changed.

Referring to FIG. 3 and FIG. 4, in the first preferred embodiment, the ratchet tool head 600 is a ratchet socket. The ratchet seat 6 includes an inner peripheral surface 61 and an outer peripheral surface 62 which are defined on opposite sides. The inner peripheral surface 61 surrounds the axis C and defines a non-circular driving hole 610. The driving hole 610 is a polygonal hole of a uniform size. The outer peripheral surface 62 includes a limiting groove 63, a first support portion 64, a ratchet toothed portion 65, a stop groove 66, a second support portion 67, a positioning groove 68, and a stop flange 622, and the above elements are sequentially arranged from bottom to top and are circumferentially formed. An outer diameter of the first support portion 64 and an outer diameter of the second support portion 67 are larger than a maximum outer diameter of the ratchet toothed portion 65. The first support portion 64 and the second support portion 67 are disposed on opposite sides of the ratchet toothed portion 65. An outer diameter of the positioning groove 68 is substantially identical to an outer diameter of the stop groove 66. The outer diameter of the positioning groove 68 is smaller than the maximum outer diameter of the ratchet toothed portion 65. An outer diameter of the stop flange 622 is larger than an inner diameter of the ratchet socket 230. The ratchet toothed portion 65 is put in the ratchet socket 230 and capable of meshing with the first actuating unit 4 or the second actuating unit 5.

Referring to FIG. 3 and FIG. 5, the limiting ring 7 is detachably disposed in the limiting groove 63. The positioning ring 7 is a flat C-shaped ring and is cross-sectionally formed in a non-circular shape, e.g., a rectangular shape. However, in other variations, it is possible that the positioning ring 3 is a flat C-shaped ring, and as long as its outer diameter is larger than the inner diameter of the ratchet socket 230 to prevent the ratchet seat 6 from escaping, the limiting effect is still attained.

The way of assembling the first preferred embodiment is described as follows with the aid of FIG. 3 and FIG. 5.

Firstly, the positioning ring 3 is installed in the annular groove 231 of the handle unit 2, and then the first actuating unit 4 and the second actuating unit 5 are put into the cavity 232. Then, the ratchet head tool 600 is installed in the handle unit 2 to put the ratchet seat 6 into the ratchet socket 230.

Finally, the limiting ring 7 is sleevedly put around the limiting groove 63. Thus, the assembly is completed.

Because an outer diameter of the limiting ring 7 and the outer diameter of the stop flange 622 are larger than the inner diameter of the ratchet socket 230, the assembly attains the limiting effect to keep the ratchet seat 6 staying in the handle 2 and prevent its escape. This invention is assembled without any hand tools and screwing operations, so the assembling procedure is simplified, the speed of carrying out the assembling operation is increased, and manufacturing costs are decreased.

Furthermore, the operation of the first preferred embodiment is described as follows.

Figure 9:
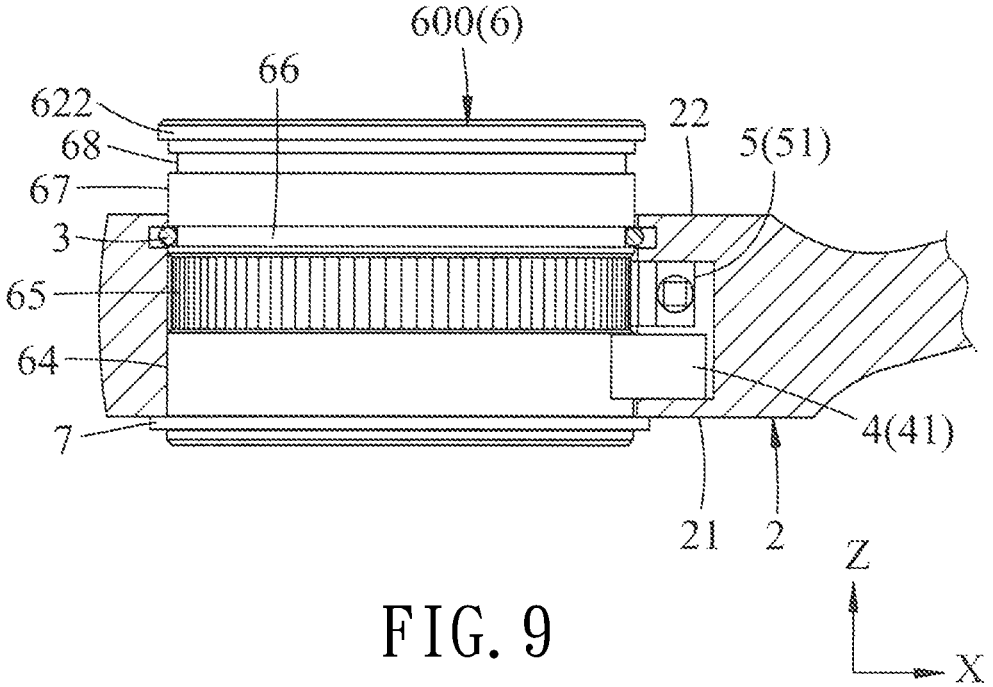
FIG. 9 is a partial cross-section view, similar to FIG. 5, showing that when the ratchet seat assumes the second position, a stop groove of the ratchet seat engages with the positioning ring by sliding.

Referring to FIG. 5 and FIG. 9, the ratchet seat 6 is moved relative to the handle unit 2 by pressing so that the ratchet seat 6 is movable between a first position (shown in FIG. 5) and a second position (shown in FIG. 9).

Referring to FIG. 4 and FIG. 5, during the operation of pressing the ratchet seat 6 and moving it to the first position, the first support portion 64 is pushed downwards from the bottom surface 21 and out of the ratchet socket 230, the limiting ring 7 leaves the bottom surface 21 of the handle unit 2, the stop flange 622 abuts against the top surface 22 to render the ratchet seat 6 unable to move downwards, and the positioning groove 68 is slidably moved to engage with the positioning ring 3. Thus, a positioning mode is attained. The first actuating part 41 meshes with the ratchet toothed portion 65 to allow the ratchet head tool 600 to be turned counterclockwise. Meanwhile, the second support portion 67 abuts against the second actuating unit 5 and makes the second actuating part 51 move backwards, and concurrently the second elastic member 52 is compressed, with the result that potential energy capable of springing back is generated.

Figure 8:
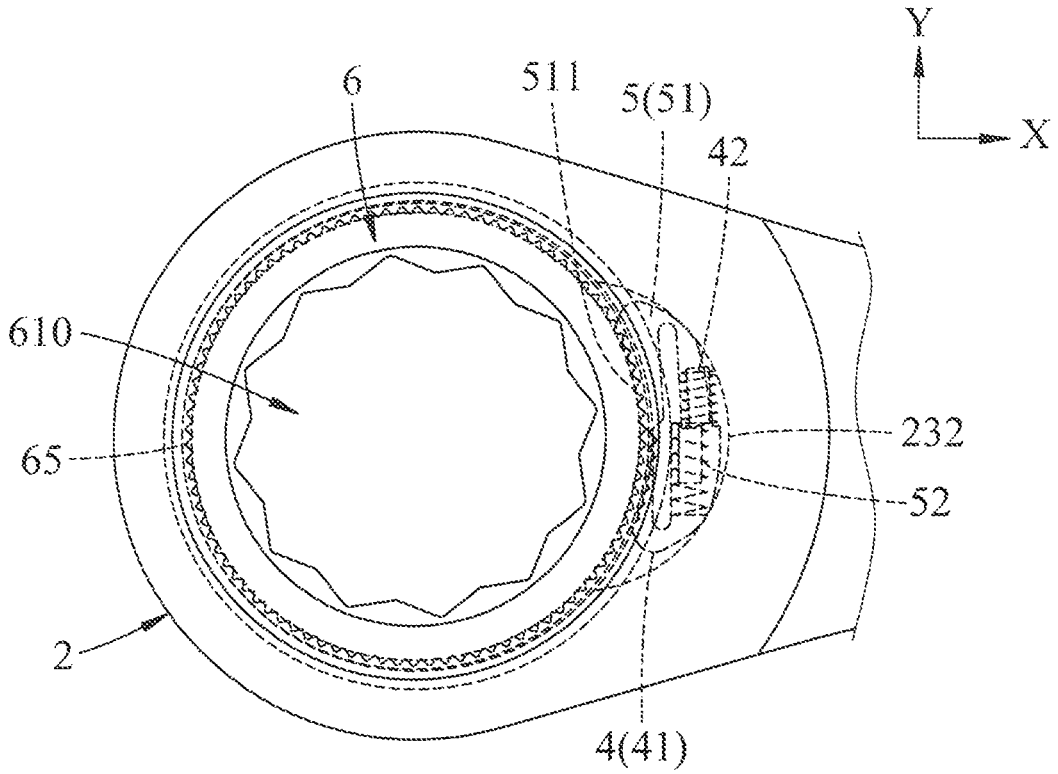
FIG. 8 is a top plan view, similar to FIG. 4, showing that when the ratchet seat assumes a second position, the second actuating unit meshes with the ratchet seat.

Referring to FIG. 8 and FIG. 9, during the operation of pressing the ratchet seat 6 and moving it to the second position, the second support portion 67 is pushed from the top surface 22 and out of the ratchet socket 230, the stop flange 622 leaves the top surface 22, the limiting ring 7 abuts against the bottom surface 21 to render the ratchet seat 6 unable to move upwards, and the positioning groove 68 disengages from the positioning ring 3 to allow the stop groove 66 to slide and then engage with the positioning ring 3. Thus, a positioning mode is attained. The second elastic member 52 releases the potential energy and pushes the second actuating part 51 forwards to make the second actuating part 51 mesh with the ratchet toothed portion 65, with the result that the ratchet tool head 600 is allowed to be turned clockwise. Meanwhile, the first support portion 64 abuts against the first actuating unit 4 and makes the first actuating part 41 move backwards, and concurrently the first elastic member 42 is compressed, with the result that potential energy capable of springing back is generated.

During the operation of changing the turning direction of the ratchet head tool 600 by pressing the ratchet seat 6, the second support portion 67 slides along the outer surface of the positioning ring 3 and pushes to stretch the positioning ring 3 as long as the added force overcomes a clamping force caused by the positioning ring 3. Accordingly, it is optional that the positioning ring 3 is lodged in the stop groove 66 or in the positioning groove 68 to change the state of the ratchet seat 6 between the first position and the second position. This invention attains an intuitive pressing operation to change the turning direction of the ratchet tool head 600, which facilitates an easy operation and allows users to operate it with one hand and use it more conveniently.

It is noted that this first preferred embodiment takes advantage of the positioning groove 68 and the stop groove 662 capable of sliding for engaging with the positioning ring 3 to attain a two-sided positioning effect. Therefore, the user not only changes the direction of the ratchet head tool 600 by the pressing operation but also changes the direction of the ratchet head tool 600 by reversing and then gripping the handle unit 2. This allows the first preferred embodiment to be used in two directions.

It is also emphasized that the first preferred embodiment discloses a detachable bidirectional ratchet wrench. When parts are worn down and are in need of replacement, the ratchet tool head 600, the first actuating unit 4, the second actuating unit 5, and the positioning ring 3 can be detached and replaced as long as the limiting ring 7 is detached. Therefore, the first preferred embodiment facilitates the maintenance and contributes to an increased service life.

Figure 10:
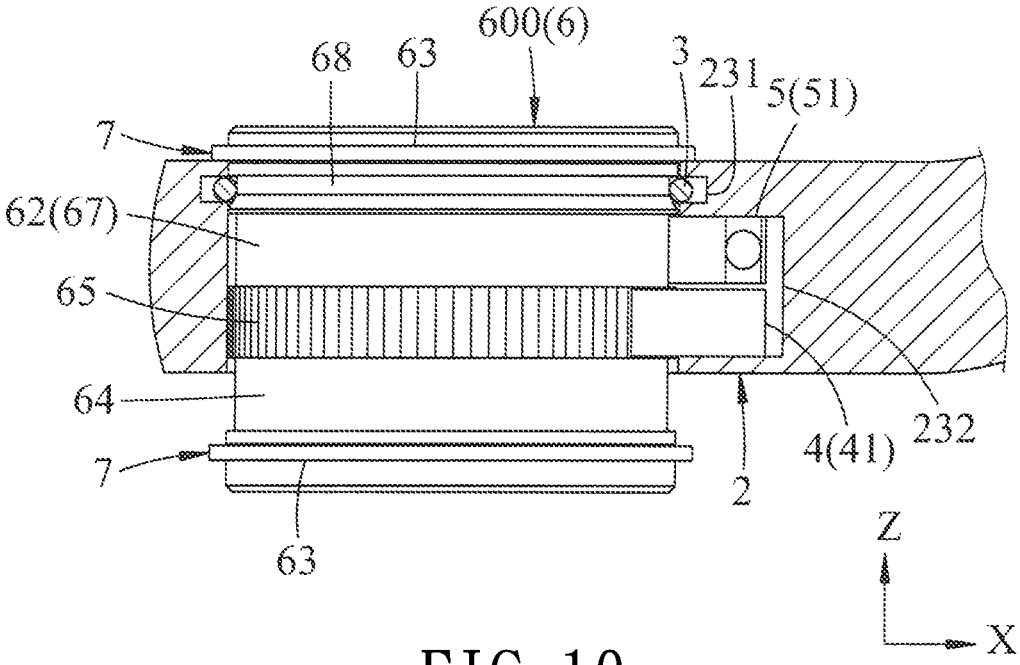
FIG. 10 is a partial cross-section view showing a second preferred embodiment of this invention and showing that the ratchet seat is in the first position.
Figure 11:
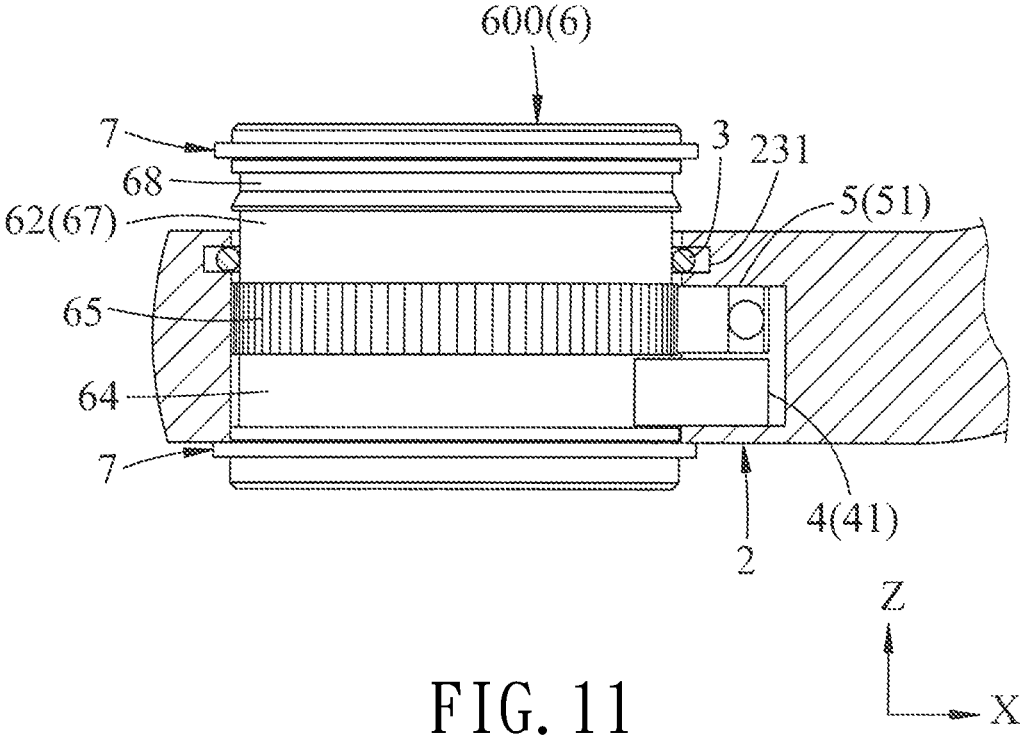
FIG. 11 is a partial cross-section view, similar to FIG. 10, showing that the ratchet seat of the second preferred embodiment is in the second position.
Figure 12:
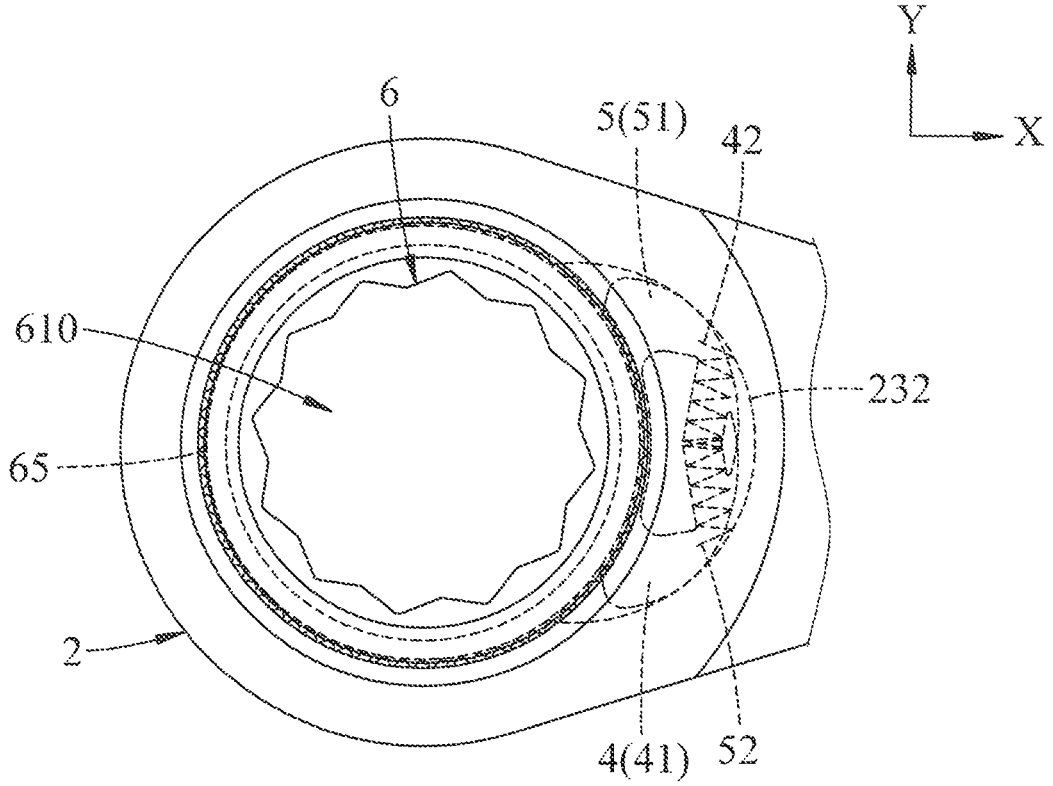
FIG. 12 is a partial top plan view showing respective locations of the first actuating unit and the second actuating unit in relation to the ratchet seat.

Referring to FIGS. 10 to 12, a second preferred embodiment of this invention is similar to the first preferred embodiment. However, the second preferred embodiment is a bidirectional ratchet socket wrench having a one-sided positioning effect. The second preferred embodiment differs from the first preferred embodiment in having the difference described as follows.

The bidirectional ratchet hand tool includes two limiting rings 7. The outer peripheral surface 62 of the ratchet seat 6 omits the stop groove 66 and the stop flange 622. The outer peripheral surface has two limiting grooves 63. The limiting grooves 63 are respectively formed at opposite top and bottom ends of the ratchet seat 6. The second support portion 67 is situated between the positioning groove 68 and the ratchet toothed portion 65. The outer diameter of the positioning groove 68, the outer diameter of the first support portion 64, and the outer diameter of the second support portion 67 are smaller than the maximum outer diameter of the ratchet toothed portion 65. The assembly attains a limiting effect because of the obstruction caused by the two limiting rings 7, which allows the ratchet seat 6 to remain in the handle unit 2 and prevents the escape.

FIG. 10 shows that when the ratchet seat 6 assumes the first position, the limiting ring 7 defined at the bottom end keeps a distance from the handle unit 2, the limiting ring 7 defined at the top end abuts against the handle unit 2, and the first actuating part 41 meshes with the ratchet toothed portion 65. Accordingly, the ratchet tool head 600 can be turned counterclockwise.

FIG. 11 shows that when the ratchet seat 6 assumes the second position, the limiting ring 7 defined at the bottom end abuts against the handle unit 2, the limiting ring 7 defined at the top end keeps a distance from the handle unit 2, and the second actuating part 51 meshes with the ratchet toothed portion 65. Accordingly, the ratchet tool head 600 can be turned clockwise.

When the ratchet seat 6 is in the second position, the positioning ring 3 is not positioned because of failure to engage with any grooves by sliding. Only the limiting ring 7 defined at the bottom end abuts against the handle unit 2. At this moment, the user can only operate the second preferred embodiment in a single direction according to the mode shown in FIG. 11 but cannot grip and use the handle unit 2 by reversing it.

Furthermore, there is another difference between the second preferred embodiment and the first preferred embodiment.

Figure 13:
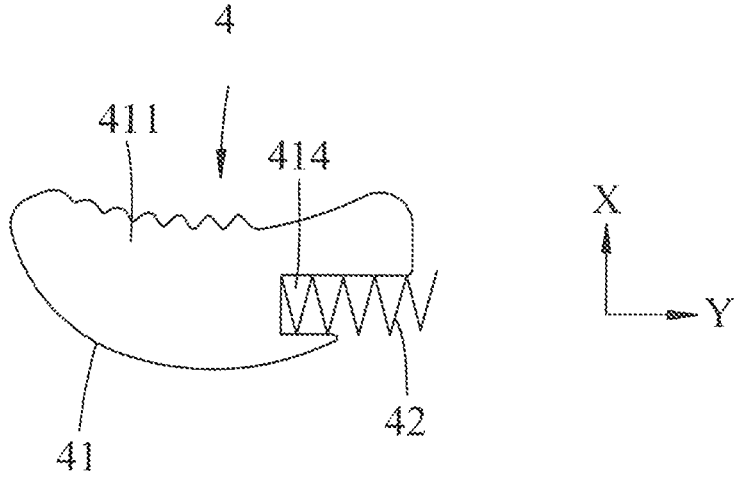
FIG. 13 is a top plan view showing a variation of the first actuating unit.

Referring to FIG. 12 and FIG. 13, the first actuating part 4 and the second actuating part 5 omit the shaft portion 412 (shown in FIG. 7) and form a fitting slot 414. The fitting slot 414 extends outwards from the engagement toothed portion 411. The first elastic member 42 is installed in the fitting slot 414 of the first actuating part 4. The second elastic member 52 and the first elastic member 42 are installed in the same way. Accordingly, the second preferred embodiment and the first preferred embodiment attain the same intuitive pressing operation.

It is also emphasized that the type of the ratchet tool head 600 is not limited to the ratchet socket. Other types of tool heads can also be adopted.

Figure 14:
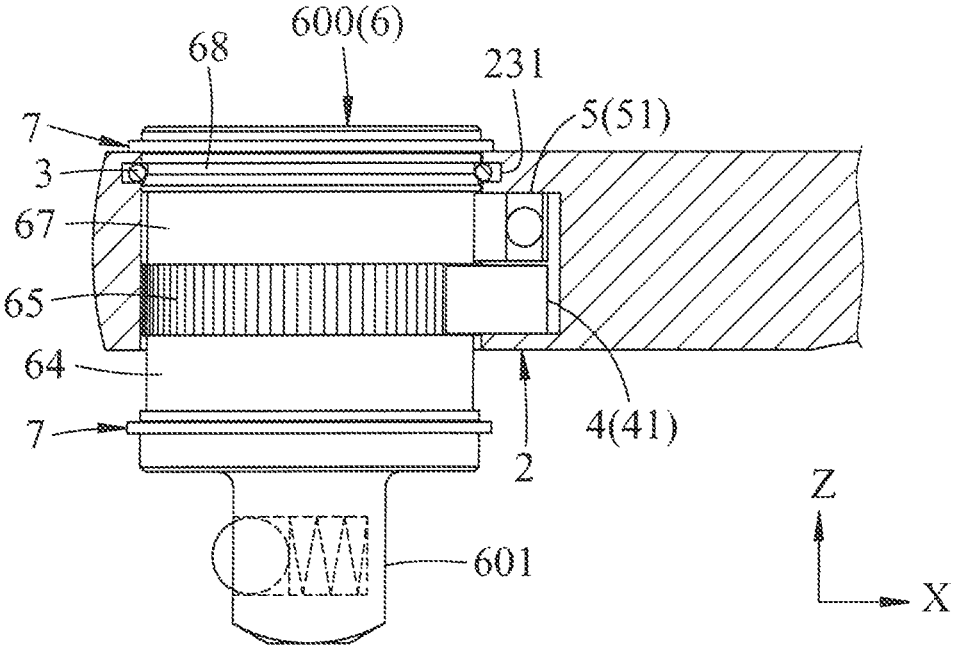
FIG. 14 is a partial cross-section view, similar to FIG. 10, showing a variation of the ratchet tool head.
Figure 15:
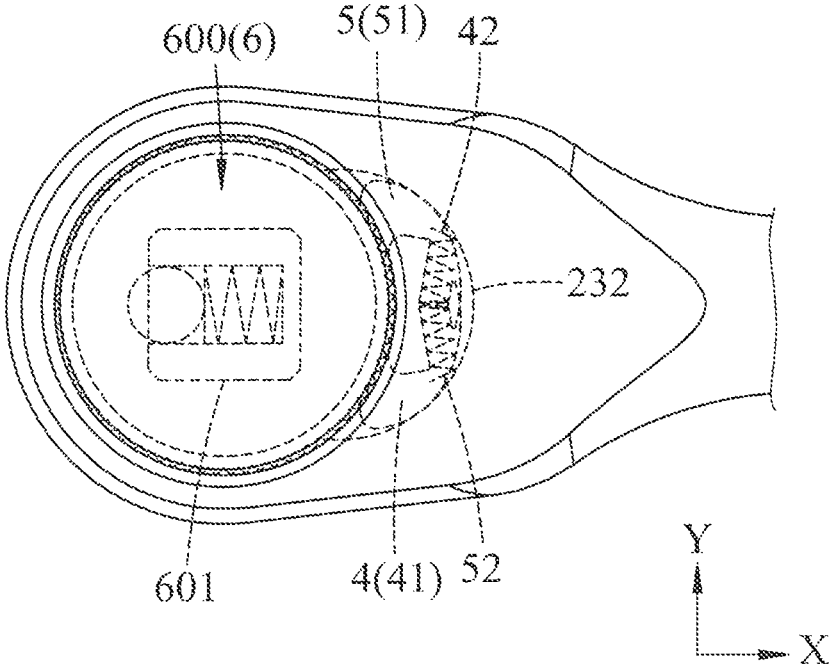
FIG. 15 is a top plan view of FIG. 14.

FIG. 14 and FIG. 15 show a variation of the ratchet tool head 600. The ratchet tool head 600 is an H handle tool head and includes a driving head 601 extending downwards from the ratchet seat 6 in the up-down direction Z. A turning operation of the driving head 601 accompanies the turning operation of the ratchet seat 6, and the driving head 601 is configured to allow a socket (not shown) to be detachably installed thereon.

Figure 16:
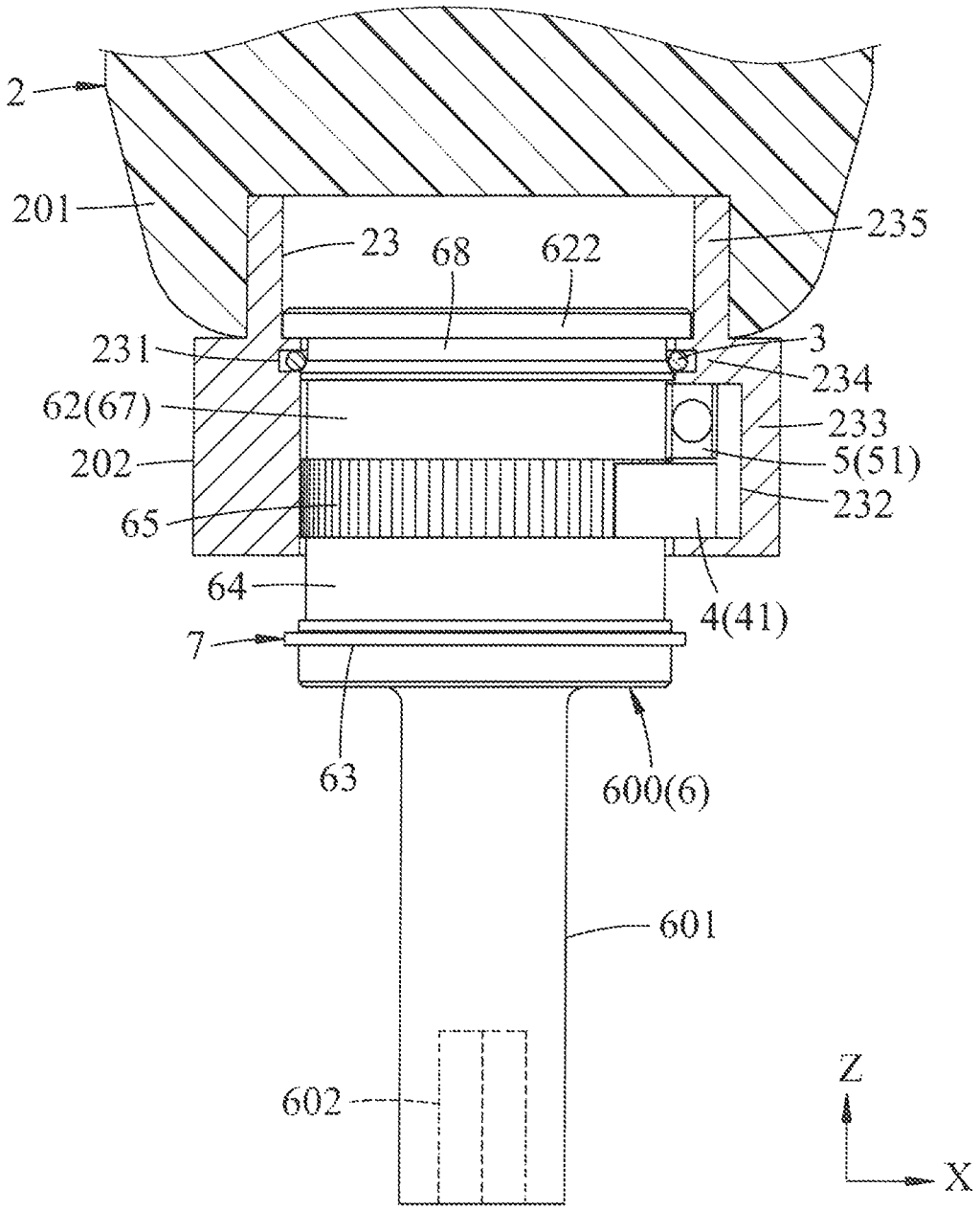
FIG. 16 is a partial cross-sectional view showing a third preferred embodiment of this invention and showing that the ratchet seat is in the first position.
Figure 17:
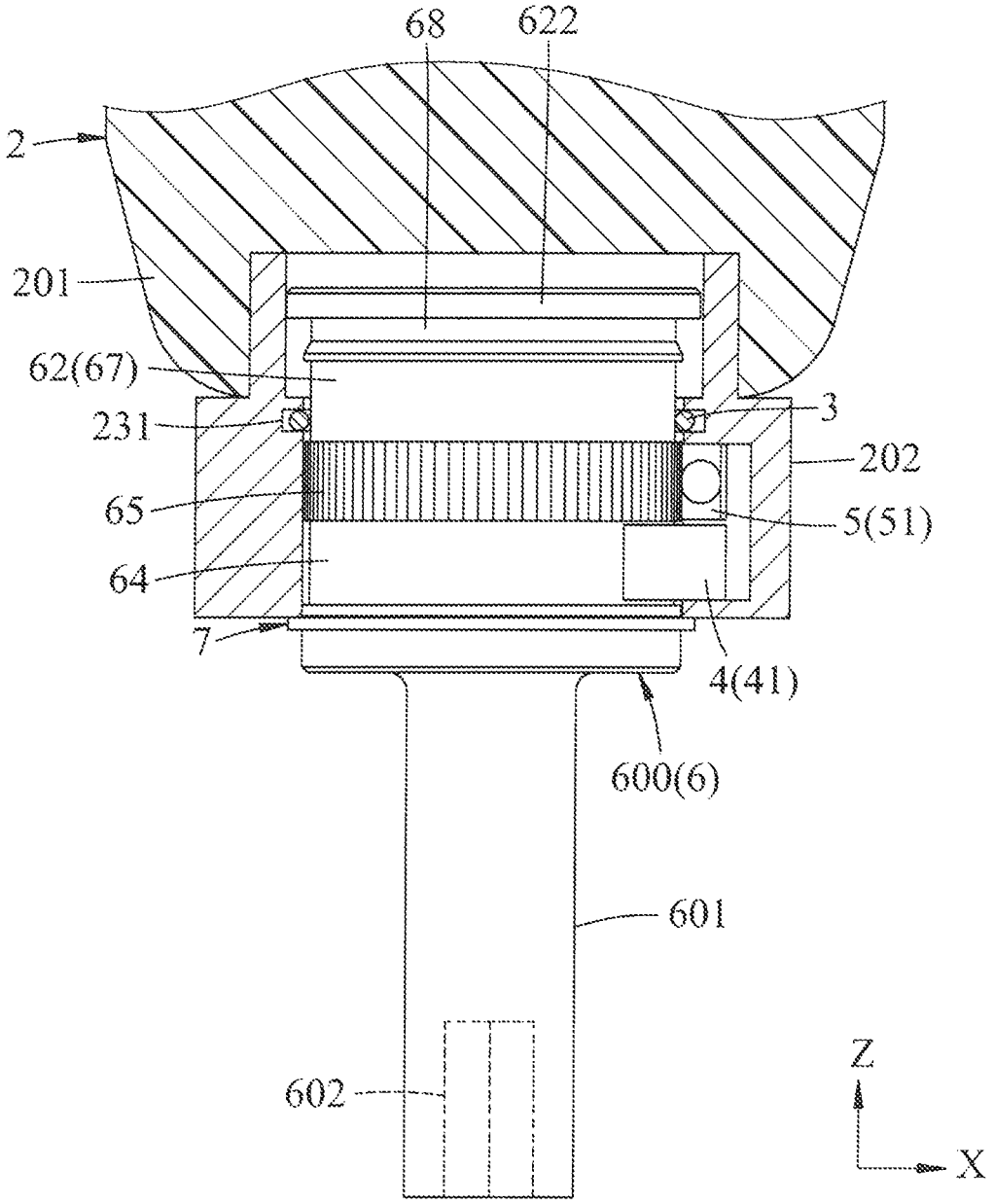
FIG. 17 is a partial cross-section view, similar to FIG. 16, showing that the ratchet seat of the third preferred embodiment is in the second position.

Referring to FIG. 16 and FIG. 17, a third preferred embodiment of this invention is similar to the second preferred embodiment. The third preferred embodiment is a hand tool functioning as a screwdriver and differs from the second preferred embodiment in having the difference described as follows.

The handle unit 2 includes a main base 201 capable of being gripped and a fitting seat 202. The fitting seat 202 includes the inner wall surface 23 and is installed at one end of the main base 201. The inner wall surface 23 is substantially formed in a step-like shape so that the ratchet socket 230 includes a first hole section 233, a second hole section 234, and a third hole section 235 which are arranged in sequence. The annular groove 231 is formed on the second hole section 234. The cavity 232 is formed on the first hole section 233.

The ratchet tool head 600 also includes a driving head 601 extending downwards from the ratchet seat 6 in the up-down direction Z. The driving head 601 has an accommodation room 602 where a head of the screwdriver can be detached and installed. The third preferred embodiment omits the limiting groove 63 (shown in FIG. 10) and the limiting ring 7 (shown in FIG. 10) which are defined at the top end and uses one stop flange 622 instead of the limiting effect caused by the above elements.

FIG. 16 shows that when the ratchet seat 6 assumes the first position, the limiting ring 7 keeps a distance from the fitting seat 202, the stop flanges 622 abuts against a place where the second hole section 234 and the third hole section 235 meet, and the first actuating part 41 meshes with the ratchet toothed portion 65. Accordingly, the ratchet tool head 600 can be turned counterclockwise.

FIG. 17 shows that when the ratchet seat 6 assumes the second position, the limiting ring 7 abuts against the fitting seat 202, the stop flange 622 keeps a distance from the place where the second hole section 234 and the third hole section 235 meet, and the second actuating part 51 meshes with the ratchet toothed portion 65. Accordingly, the ratchet tool head 600 can be turned clockwise.

The third preferred embodiment shows that the main base 201 and the fitting seat 202 of the handle 2 are disposed independently of each other in order to facilitate the assembling procedure. It is required that the ratchet tool head 600 is installed onto the fitting seat 202 firstly, and then the fitting seat 202 is embedded into the main body 201. Accordingly, the third preferred embodiment also attains the effect of carrying out the intuitive pressing operation.

Figure 18:
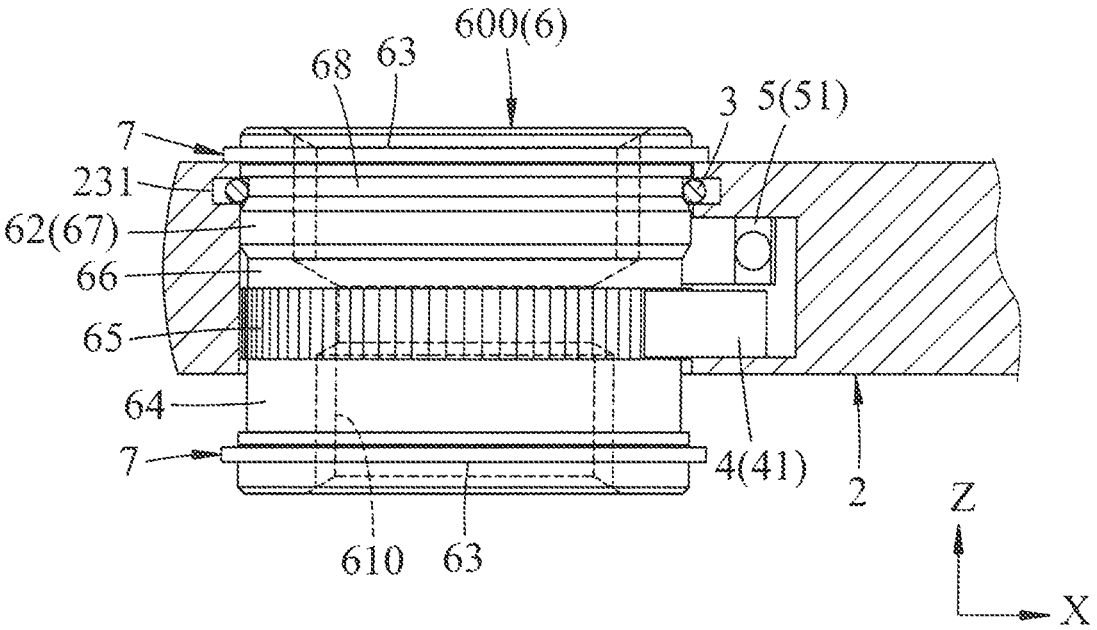
FIG. 18 is a partial cross-sectional view showing a fourth preferred embodiment of this invention and showing that the ratchet seat is in the first position.
Figure 19:
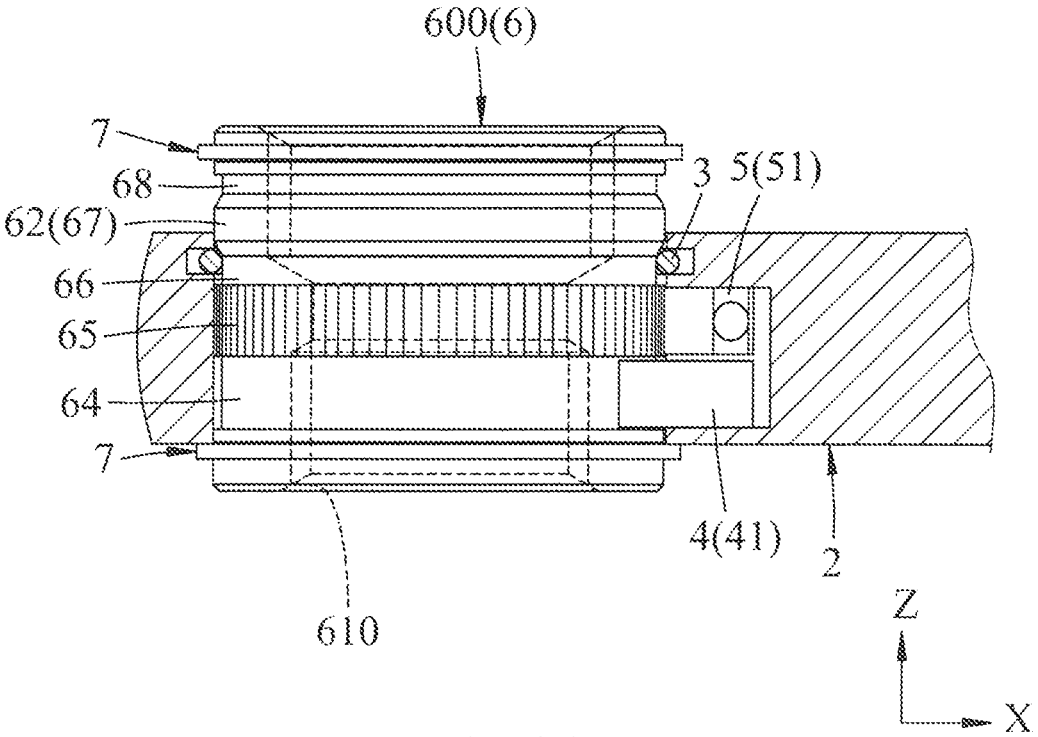
FIG. 19 is a partial cross-section view, similar to FIG. 18, showing that the ratchet seat of the fourth preferred embodiment is in the second position.

Referring to FIG. 18 and FIG. 19, a fourth preferred embodiment of this invention is similar to the first preferred embodiment. Both preferred embodiments are related to a bidirectional ratchet socket wrench attaining the two-sided positioning effect. The difference between the two preferred embodiments is described as follows.

In the fourth preferred embodiment, the stop flange 622 defined at the top end (shown in FIG. 5) is omitted, and the limiting groove 63 and the limiting ring 7 which are defined at the top end are provided instead of the limiting effect caused by the above element. Meanwhile, the shape of the ratchet seat 6 is changed. The driving hole 610 of the ratchet seat 6 has two different inner hole diameters, and the outer diameter of the first support portion 64 is smaller than the outer diameter of the second support portion 67 and the outer diameter of the ratchet toothed portion 65. Opposite top and bottom ends of the second support portion 67 are chamfered. Accordingly, the ratchet seat 6 slides smoothly between the first position (shown in FIG. 18) and the second position (shown in FIG. 19). The fourth preferred embodiment is adapted to tighten and loosen sockets (not shown) of two different sizes by changing the direction of gripping the handle unit 2 and pressing the ratchet seat 6.

FIG. 18 shows that when the ratchet seat 6 assumes the first position, the limiting ring 7 defined at the bottom end keeps a distance from the handle unit 2, the limiting ring 7 defined at the top end abuts against the handle unit 2, and the first actuating part 41 meshes with the ratchet toothed portion 65. Accordingly, the ratchet tool head 600 can be turned counterclockwise.

FIG. 19 shows that when the ratchet seat 6 assumes the second position, the limiting ring 7 defined at the bottom end abuts against the handle unit 2, the limiting ring 7 defined at the top end keeps a distance from the handle unit 2, and the second actuating part 51 meshes with the ratchet toothed portion 65. Accordingly, the ratchet tool head 600 can be turned clockwise.

The fourth preferred embodiment and the first preferred embodiment have the advantages, including the intuitive pressing operation, the bidirectional use, and detachable elements, and both embodiments are adapted to assembly and disengage sockets of two different sizes.

Likewise, the fourth preferred embodiment can only use one limiting ring 7 and one stop flange 622 to attain the same limiting effect. The detailed descriptions of the variations can be described as follows.

Figure 20:
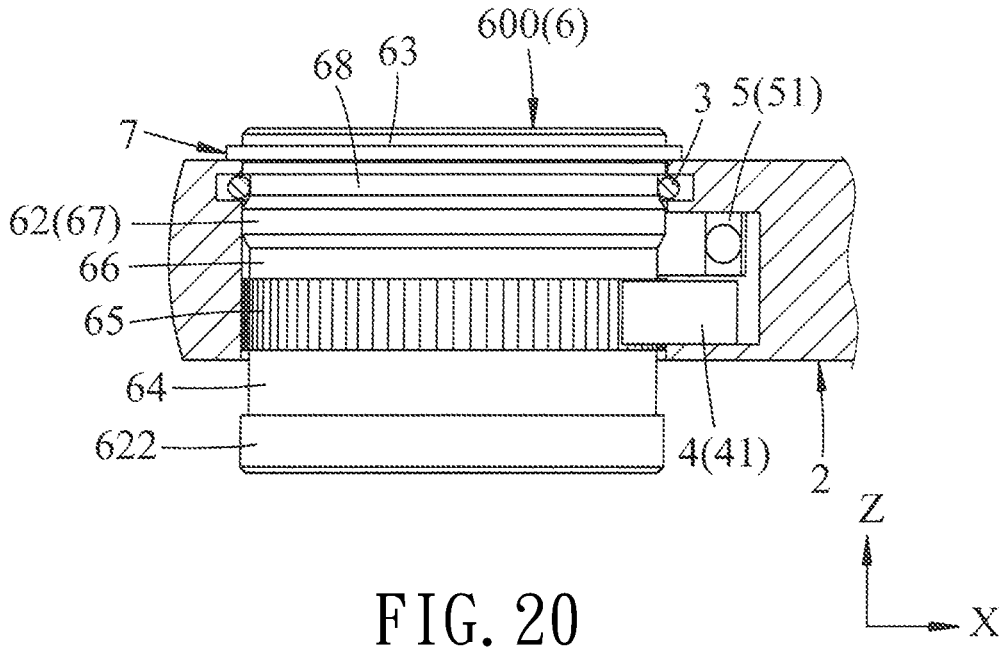
FIG. 20 is a partial cross-sectional view, similar to FIG. 18, showing a variation of the ratchet seat and showing that the ratchet seat is in the first position.
Figure 21:
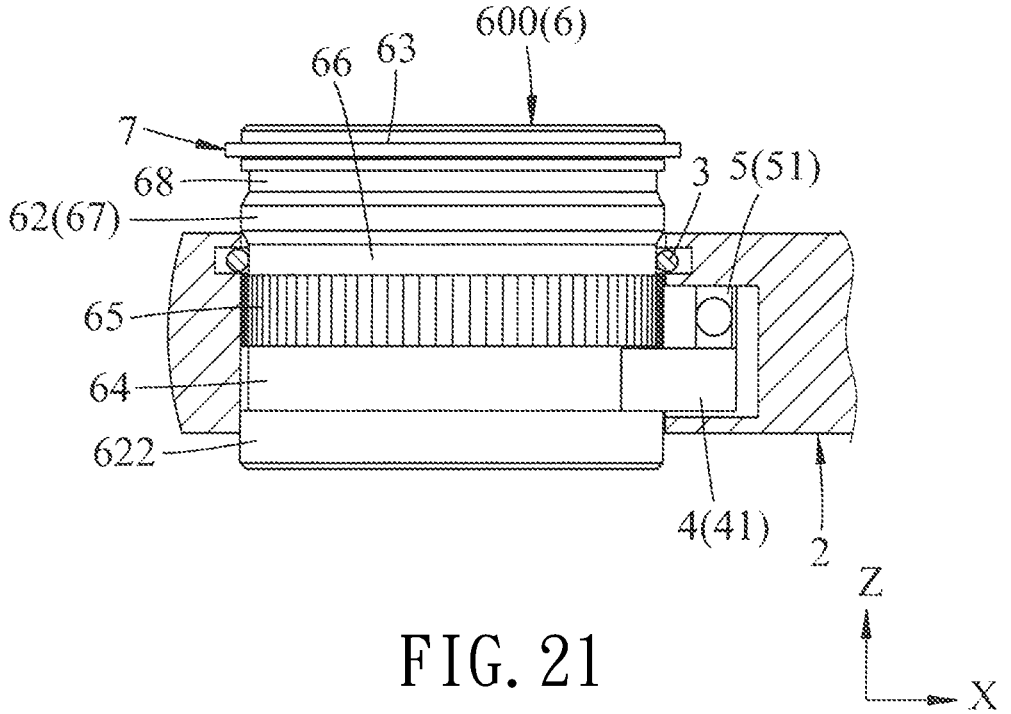
FIG. 21 is a partial cross-sectional view, similar to FIG. 20, showing that the variation of the ratchet seat is in the second position.

Referring to FIG. 20 and FIG. 21, one stop flange 622 is used to replace the limiting ring 7 and the corresponding limiting groove 63 which are disposed defined at the bottom end, and the stop flange 622 abuts on the first support portion 64 and has an outer diameter larger than the outer diameter of the first support portion 64. This arrangement also allows the ratchet seat 6 to be movable between the first position (shown in FIG. 20) and the second position (shown in FIG. 21).

Figure 22:
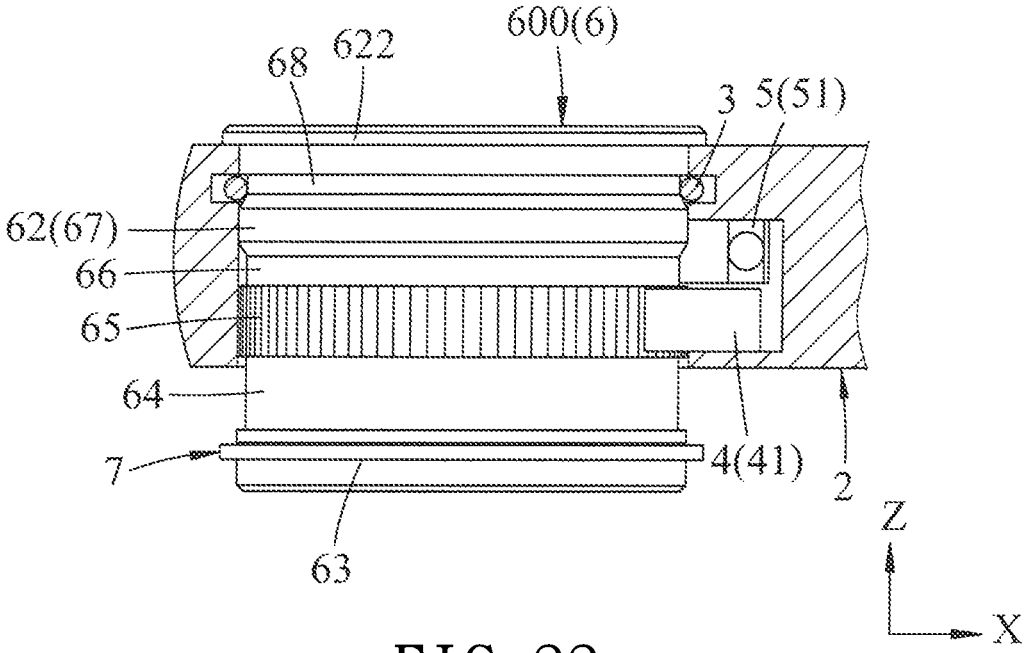
FIG. 22 is a partial cross-sectional view, similar to FIG. 18, showing another variation of the ratchet seat and showing that the ratchet seat is in the first position.
Figure 23:
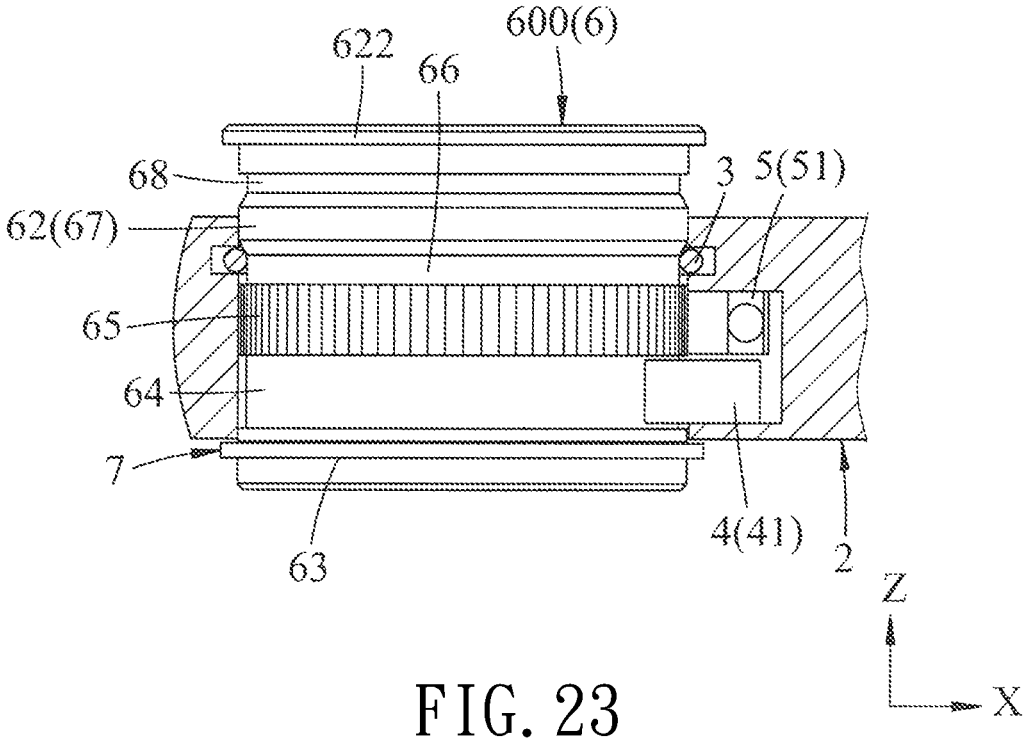
FIG. 23 is a partial cross-sectional view, similar to FIG. 22, showing that the other variation of the ratchet seat is in the second position.

Alternatively, FIG. 22 and FIG. 23 show that one stop flange 622 is used to replace the limiting ring 7 and the corresponding limiting groove 63 which are disposed defined at the top end, and the stop flange 622 is adjacent to the positioning groove 68 and provided with an outer diameter larger than the outer diameter of the second support portion 67. This arrangement also allows the ratchet seat 6 to be movable between the first position (shown in FIG. 22) and the second position (shown in FIG. 23). According to the above variations, the variations can be made without departing from the scope of this invention as long as the arrangement of the limiting ring 7 or the stop flange 622 can function to have the limiting effect on the ratchet seat 6.

Figure 24:
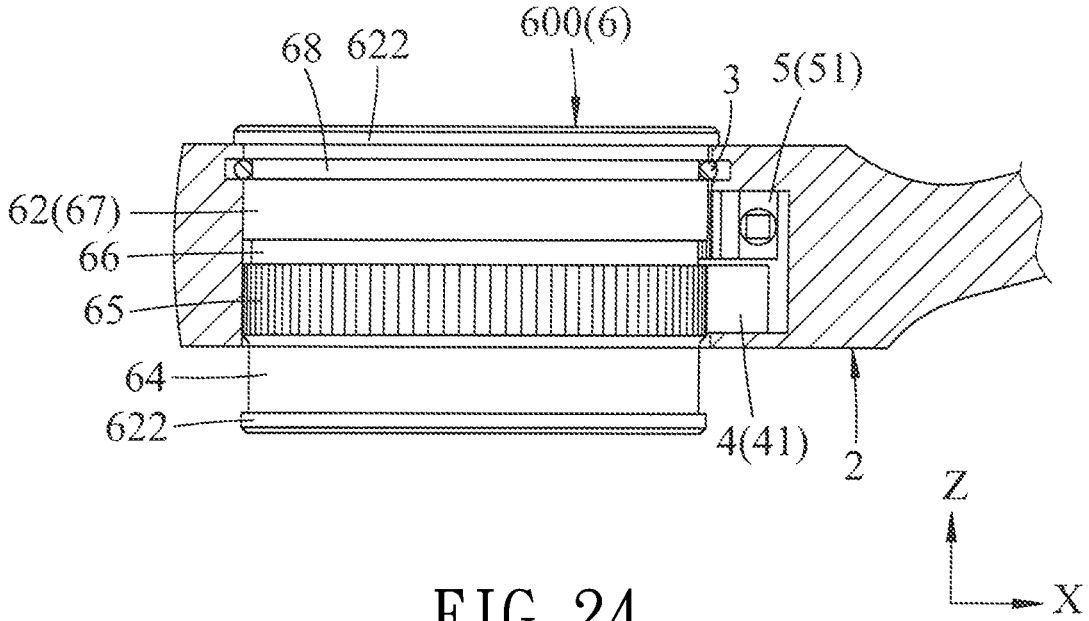
FIG. 24 is a partial cross-sectional view showing a fifth preferred embodiment of this invention and showing that the ratchet seat is in the first position.
Figure 25:
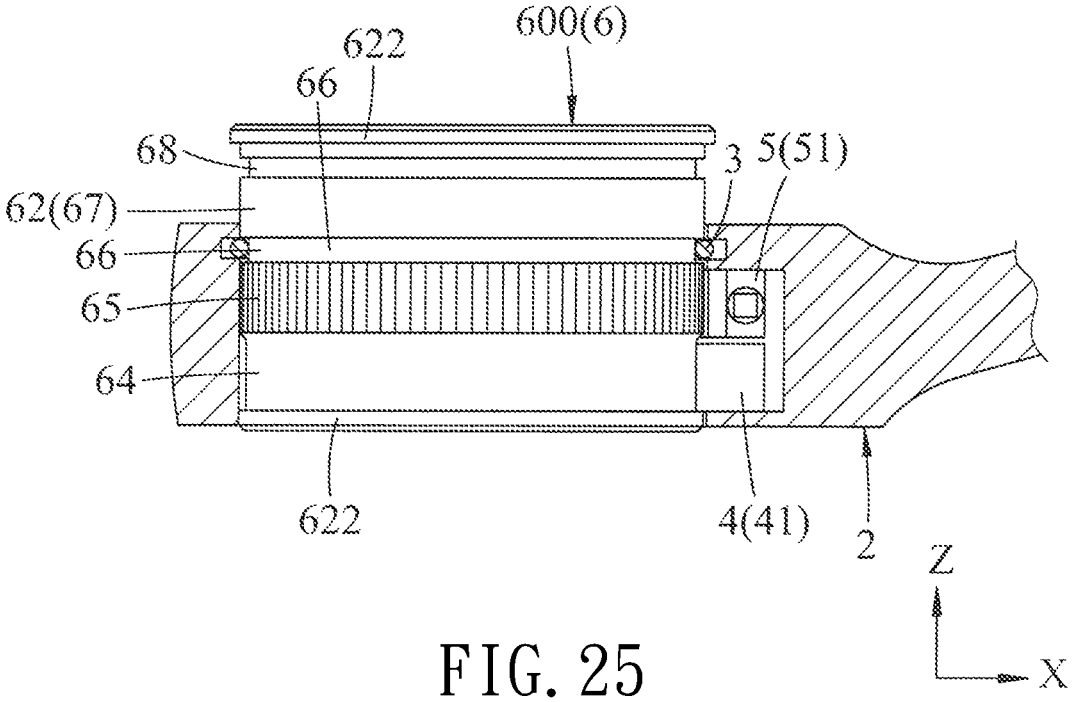
FIG. 25 is a partial cross-section view, similar to FIG. 24, showing that the ratchet seat of the fifth preferred embodiment is in the second position.

Referring to FIG. 24 and FIG. 25, a fifth preferred embodiment of this invention is similar to the fourth preferred embodiment. The difference between the two preferred embodiments is described as follows.

The fifth preferred embodiment is a bidirectional ratchet socket wrench which is not detachable. The bidirectional ratchet hand tool omits the limiting rings 7 (shown in FIG. 18) and the limiting grooves 63 (shown in FIG. 18) and uses two stop flanges 622 instead of the limiting effect caused by the above elements. This arrangement also allows the ratchet seat 6 to be movable between the first position (shown in FIG. 24) and the second position (shown in FIG. 25) and attains the effect of carrying out the intuitive pressing operation.

FIG. 24 shows that when the ratchet seat 6 assumes the first position, the stop flange 622 defined at the bottom end keeps a distance from the handle unit 2, the stop flange 622 defined at the top end abuts against the handle unit 2, and the first actuating part 41 meshes with the ratchet toothed portion 65. Accordingly, the ratchet tool head 600 can be turned counterclockwise.

FIG. 25 shows that when the ratchet seat 6 assumes the second position, the stop flange 622 defined at the bottom end abuts against the first actuating part 41, the stop flange 622 defined at the top end keeps a distance from the handle unit 2, and the second actuating part 51 meshes with the ratchet toothed portion 65. Accordingly, the ratchet tool head 600 can be turned clockwise. It is emphasized that when the ratchet seat 6 is in the second position, the stop flange 622 defined at the bottom end enters the ratchet socket 230 and abuts against the first actuating part 41 to attain the limiting effect. Therefore, in the fifth preferred embodiment, the first actuating part 41 stops the stop flange 622 defined at the bottom end after the assembling operation is done, with the result that the elements cannot be detached and replaced. However, because the fifth preferred embodiment omits two limiting rings 7, fewer elements are needed to be conducive to the reduction in the manufacturing costs.

Figure 26:
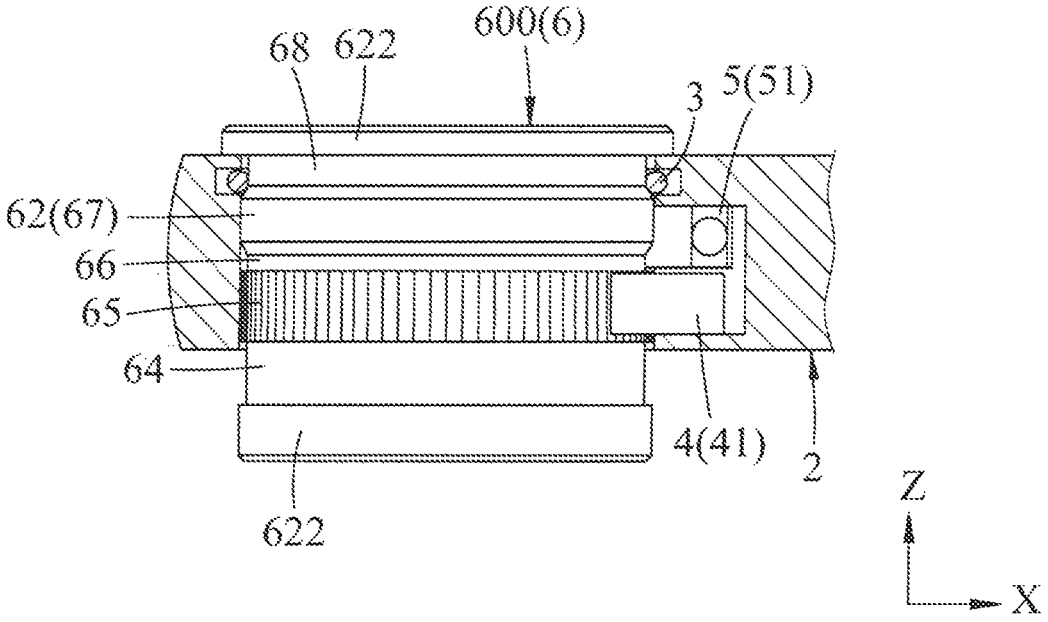
FIG. 26 is a partial cross-sectional view showing a sixth preferred embodiment of this invention and showing that the ratchet seat is in the first position.
Figure 27:
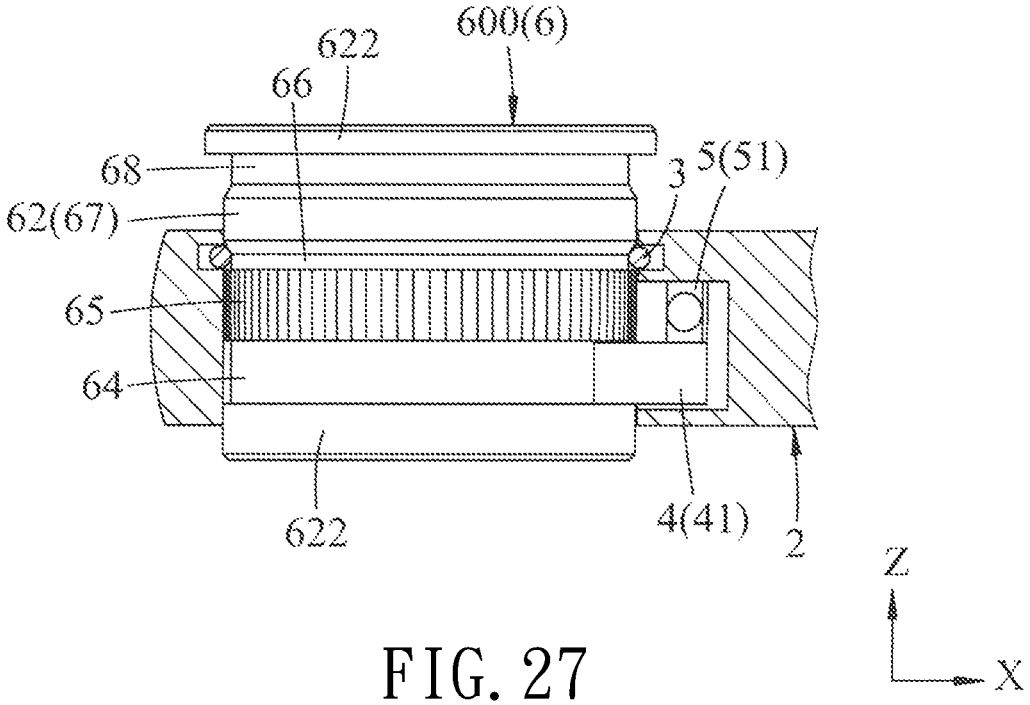
FIG. 27 is a partial cross-section view, similar to FIG. 26, showing that the ratchet seat of the sixth preferred embodiment is in the second position.

Referring to FIG. 26 and FIG. 27, a sixth preferred embodiment of this invention is similar to the fifth preferred embodiment. Both preferred embodiments are related to a bidirectional ratchet socket wrench which is not detachable. The difference between the two preferred embodiments is described as follows.

In the sixth preferred embodiment, the shape of the ratchet seat 6 is changed, and opposite top and bottom ends of the second support portion 67 are chamfered, so the ratchet seat 6 slides smoothly between the first position (shown in FIG. 26) and the second position (shown in FIG. 27). Meanwhile, the stop flange 622 defined at the bottom end has an outer diameter larger than the outer diameter of the first support portion 64 and abuts on the first support portion 64. The stop flange 622 defined at the top end has an outer diameter larger than the outer diameter of the second support portion 67 and abuts on the positioning groove 68.

FIG. 26 shows that when the ratchet seat 6 assumes the first position, the stop flange 622 defined at the bottom end keeps a distance from the handle unit 2, the stop flange 622 defined at the top end abuts against the handle unit 2, and the first actuating part 41 meshes with the ratchet toothed portion 65. Accordingly, the ratchet tool head 600 can be turned counterclockwise.

FIG. 27 shows that when the ratchet seat 6 assumes the second position, the stop flange 622 defined at the bottom end abuts against the first actuating part 41, the stop flange 622 defined at the top end keeps a distance from the handle unit 2, and the second actuating part 51 meshes with the ratchet toothed portion 65. Accordingly, the ratchet tool head 600 can be turned clockwise.

Likewise, the sixth preferred embodiment has the same intuitive pressing operation disclosed in the fifth preferred embodiment and reduces the manufacturing costs.

To sum up, the bidirectional ratchet hand tool of this invention can be assembled with a simplified procedure, be quickly assembled, and be manufactured with lower costs. Meanwhile, this invention takes advantage of the first actuating unit 4 and the second actuating unit 5 which are placed over one another in the up-down direction Z to change the turning direction of the ratchet tool head 600 by pressing the ratchet seat 6. It is convenient to carry out the intuitive pressing operation whereby the objects of this invention are exactly attained.

While the embodiments are shown and described above, it is understood that the embodiments related to this invention should not limit the scope of this invention and that further variations and modifications may be made without departing from the scope of this invention.

What is claimed is:

1. A bidirectional ratchet hand tool comprising;

a handle unit including a ratchet socket enclosed by an inner wall surface, said inner wall surface including an annular groove annularly formed and radially extending outwards from said ratchet socket and a cavity communicating with said ratchet socket, said annular groove and said cavity being spaced from each other in an up-down direction;

a positioning ring fitting a shape of said annular groove and configured to be stretchably disposed in said annular groove;

a first actuating unit configured to be elastically disposed in said cavity;

a second actuating unit configured to be elastically disposed in said cavity and placed on said first actuating unit in said up-down direction; and a ratchet tool head movably disposed in said ratchet socket in said up-down direction and including a ratchet seat, said ratchet seat being capable of meshing with said first actuating unit or said second actuating unit, an outer peripheral surface of said ratchet seat forming a ratchet toothed portion received in said ratchet socket and a positioning groove spaced from said ratchet toothed portion in said up-down direction, said ratchet seat being moved relative to said handle unit by pressing and being movable between a first position and a second position, said first position being assumed when said positioning groove is slidably moved to engage with said positioning ring, and said first actuating unit meshes with said ratchet toothed portion to thereby allow said ratchet tool head to be turned in one direction, said second position being assumed when said positioning groove disengages from said positioning ring, and said second actuating unit meshes with said ratchet toothed portion to thereby allow said ratchet tool head to be turned unidirectionally in another direction.

2. The bidirectional ratchet hand tool according to claim 1, wherein said outer peripheral surface of said ratchet seat forms a first support portion and a second support portion which are disposed on opposite sides of said ratchet toothed portion, said second support portion being situated between said positioning groove and said ratchet toothed portion, said second support portion abutting against said second actuating unit when said first position is assumed, said first support portion abutting against said first actuating unit when said second position is assumed.

3. The bidirectional ratchet hand tool according to claim 2, wherein said outer peripheral surface of said ratchet seat forms a stop groove between said ratchet toothed portion and said second support portion, said stop groove being slidably moved to engage with said positioning ring while assuming said second position.

4. The bidirectional ratchet hand tool according to claim 3, wherein said outer peripheral surface of said ratchet seat forms two stop flanges, one of said two stop flanges having an outer diameter larger than an outer diameter of said first support portion and abutting on said first support portion, the other one of said two stop flanges having an outer diameter larger than an outer diameter of said second support portion and being adjacent to said positioning groove, when said ratchet seat assumes said first position, said one stop flange keeps a distance from said handle unit, and said other stop flange abuts against said handle unit, when said ratchet seat assumes said second position, said one stop flange abuts against said first actuating unit, and said other stop flange keeps a distance from said handle unit.

5. The bidirectional ratchet hand tool according to claim 2, wherein said ratchet tool head is detachably installed on said handle unit, said outer peripheral surface of said ratchet seat forming at least one limiting groove, said bidirectional ratchet hand tool further comprising at least one limiting ring detachably disposed in said at least one limiting groove, said at least one limiting ring being configured to abut against said handle unit.

6. The bidirectional ratchet hand tool according to claim 5, wherein said outer peripheral surface of said ratchet seat forms a stop flange abutting on said first support portion, an outer diameter of said stop flange being larger than an outer diameter of said first support portion, when said ratchet seat assumes said first position, said stop flange keeps a distance from said handle unit, and said at least one limiting ring abuts against said handle unit, when said ratchet seat assumes said second position, said stop flange abuts against said first actuating unit, and said at least one limiting ring keeps a distance from said handle unit.

7. The bidirectional ratchet hand tool according to claim 5, wherein said outer peripheral surface of said ratchet seat forms a stop flange adjacent to said positioning groove, an outer diameter of said stop flange being larger than an outer diameter of said second support portion, when said ratchet seat assumes said first position, said stop flange abuts against said handle unit, and said at least one limiting ring keeps a distance from said handle unit, when said ratchet seat assumes said second position, said stop flange keeps a distance from said handle unit, and said at least one limiting ring abuts against said handle unit.

8. The bidirectional ratchet hand tool according to claim 5, wherein said at least one limiting groove comprises two limiting grooves, said at least one limiting ring comprises two limiting rings respectively and detachably disposed in said two limiting grooves, when said ratchet seat assumes said first position, one of said two limiting rings keeps a distance from said handle unit, and the other one of said two limiting rings abuts against said handle unit, when said ratchet seat assumes said second position, said one limiting ring abuts against said handle unit, and said other limiting ring keeps a distance from said handle unit.

9. The bidirectional ratchet hand tool according to claim 1, wherein said first actuating unit includes a first actuating part movable relative to said cavity and a first elastic member configured to push said first actuating part springily, said second actuating unit including a second actuating part movable relative to said cavity and a second elastic member configured to push said second actuating part springily, said first actuating part and said second actuating part each including an engagement toothed portion configured to mesh with said ratchet seat and a shaft portion extending outwards from said engagement toothed portion, said first elastic member being sleevedly disposed around said shaft portion of said first actuating part, said second elastic member being sleevedly disposed around said shaft portion of said second actuating part.

10. The bidirectional ratchet hand tool according to claim 1, wherein said first actuating unit includes a first actuating part movable relative to said cavity and a first elastic member configured to push said first actuating part springily, said second actuating unit including a second actuating part movable relative to said cavity and a second elastic member configured to push said second actuating part springily, said first actuating part and said second actuating part each including an engagement toothed portion configured to mesh with said ratchet seat and a fitting slot extending outwards from said engagement toothed portion, said first elastic member being installed in said fitting slot of said first actuating part, said second elastic member being installed in said fitting slot of said second actuating part.

11. The bidirectional ratchet hand tool according to claim 1, wherein said handle unit includes two opposite outer surfaces formed in said up-down direction, said ratchet socket penetrating through said two outer surfaces, said annular groove being adjacent to one of said two outer surfaces.

12. The bidirectional ratchet hand tool according to claim 1, wherein said ratchet tool head includes a driving head extending outwards from said ratchet seat.

13. The bidirectional ratchet hand tool according to claim 12, wherein said handle unit includes a main base capable of being gripped and a fitting seat, said fitting seat including said inner wall surface and being installed at one end of said main base.

* * * * *